US007232207B2

(12) United States Patent
Watanabe

(10) Patent No.: US 7,232,207 B2
(45) Date of Patent: Jun. 19, 2007

(54) INK JET HEAD

(75) Inventor: Hideo Watanabe, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 209 days.

(21) Appl. No.: 10/742,543

(22) Filed: Dec. 18, 2003

(65) Prior Publication Data

US 2004/0130602 A1 Jul. 8, 2004

(30) Foreign Application Priority Data

Dec. 27, 2002 (JP) ..... 2002-381766
Jun. 3, 2003 (JP) ..... 2003-158408
Jun. 24, 2003 (JP) ..... 2003-180255

(51) Int. Cl.
*B41J 2/045* (2006.01)
*B41J 2/14* (2006.01)

(52) U.S. Cl. ..... 347/69; 347/50; 347/68

(58) Field of Classification Search ..... 347/50, 347/68–72

See application file for complete search history.

(56) References Cited

U.S. PATENT DOCUMENTS 4,766,671 A * 8/1988 Utsumi et al. ..... 29/848
5,113,204 A * 5/1992 Miyazawa et al. ..... 347/68
5,627,576 A * 5/1997 Inui et al. ..... 347/68
5,666,145 A * 9/1997 Hayes et al. ..... 347/71
6,281,914 B1 * 8/2001 Hiwada et al. ..... 347/50

* cited by examiner

*Primary Examiner*—Stephen Meier
*Assistant Examiner*—Geoffrey S. Mruk
(74) *Attorney, Agent, or Firm*—Frishauf, Holtz, Goodman & Chick, P.C.

(57) ABSTRACT

An ink jet head having a head chip with drive walls made of piezoelectric elements and channel portions alternately arranged in parallel; a top-side and a bottom-side base plates each formed to be longer than the channel portions and fixed on an upper and lower surfaces of the head chip; an ink supply room forming member for forming an ink supply room to supply ink to each of the channel portions; first lead wires to be connected to their respective drive electrodes formed on the drive walls, said first lead wires being formed on a fixed surface of the head chip to be fixed to the base plate; and second lead wires to be connected to the first lead wires, said second lead wires being formed on the surface of the top-side and/or the bottom-side base plate at the side of the fixed surface of the head chip.

30 Claims, 23 Drawing Sheets

E

FIG. 10 ( a )
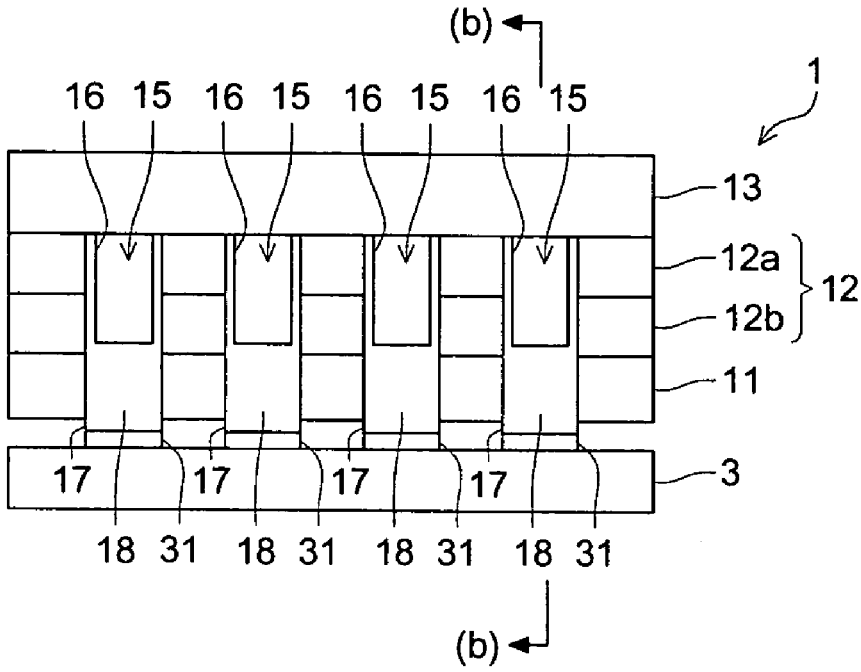
FIG. 10 ( b )
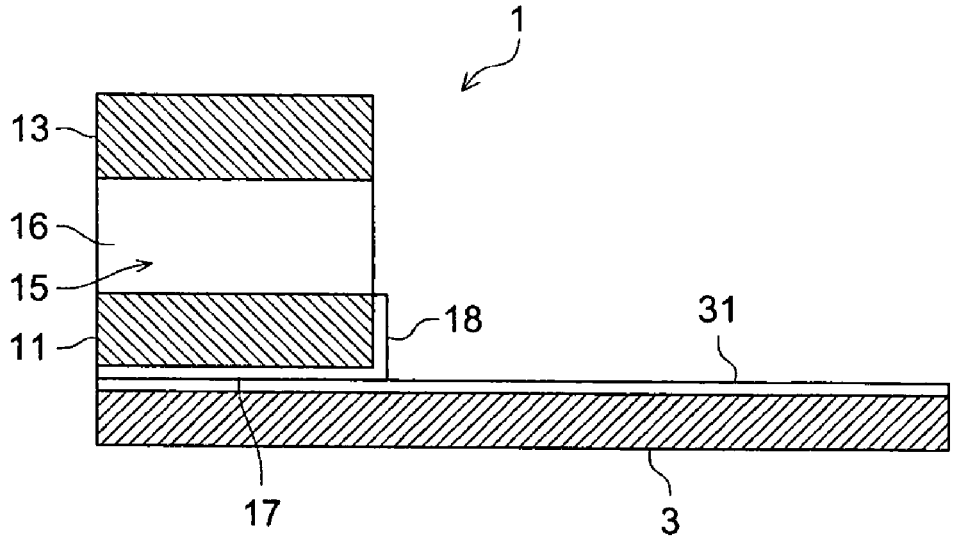

FIG. 22 ( a )
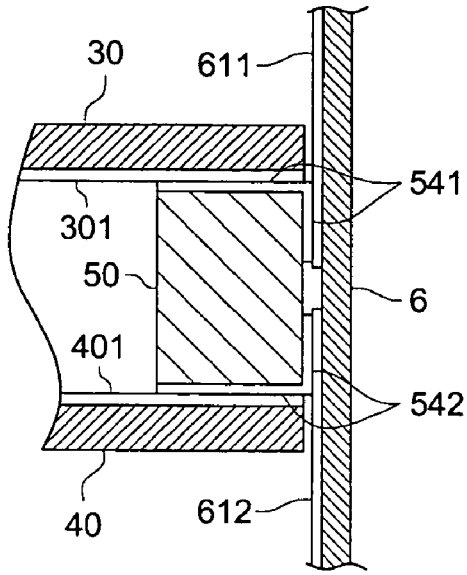
FIG. 22 ( b )
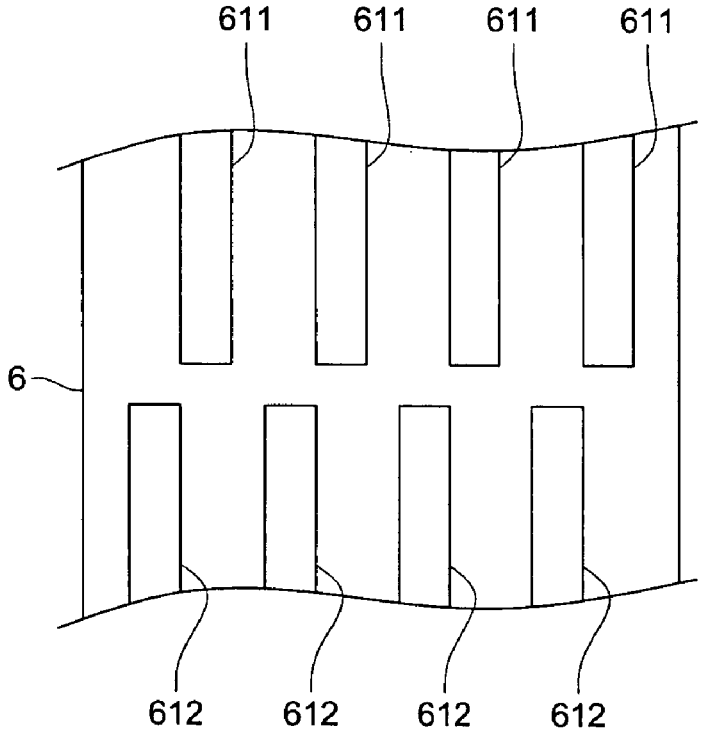

FIG. 30 ( a )
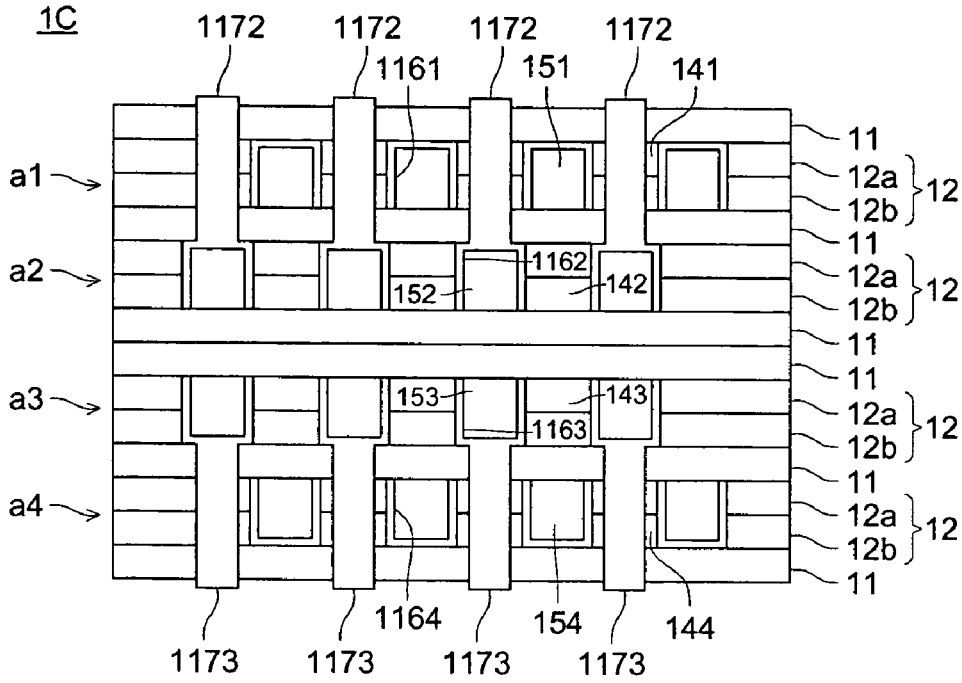
FIG. 30 ( b )
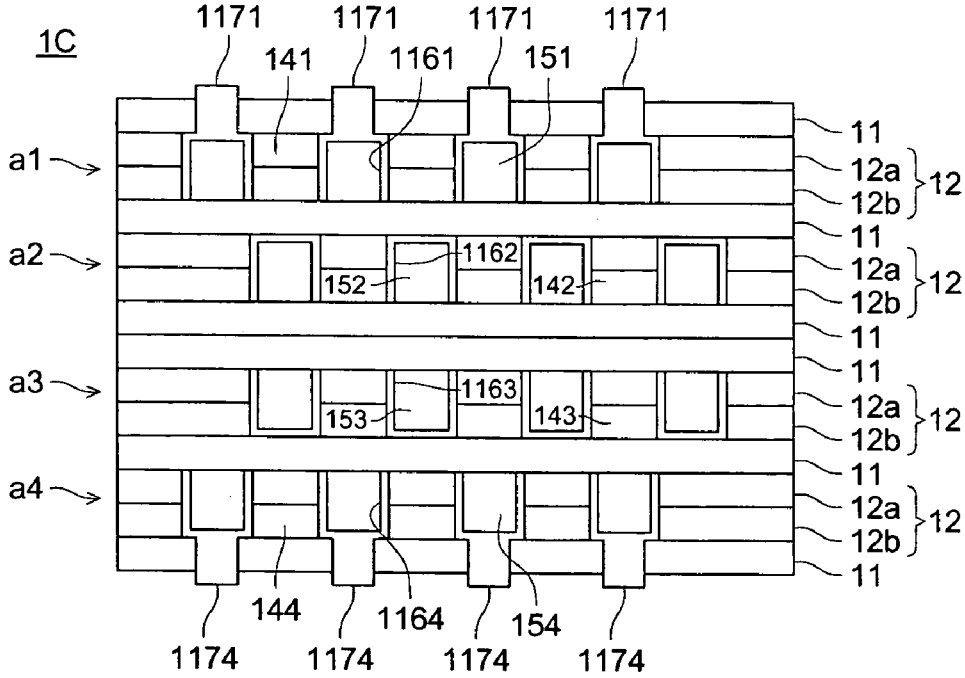

INK JET HEAD

BACKGROUND OF THE INVENTION

This invention relates to an ink jet head, and in particular, to an ink jet head having a head chip in which drive walls made up of an piezoelectric element and channel portions are arranged alternately, the inlet and outlet of the channel portions are arranged in an opposite manner on the front side and rear side respectively, and by the application of a voltage to said drive walls to deform said walls by a shearing force, ink drops in the channel portions are jetted.

Up to this time, it is known to the public, as an ink jet head of a shear-mode type jetting ink drops in the channel portions by the application of a voltage to the drive walls partitioning the channel portions to deform the drive walls by a shearing force, an ink jet head which can be obtained as one of a number of heads produced from a wafer with its productivity extremely improved, owing to its actuator being made up of a head chip of what is called a harmonica type in which drive walls made up of a piezoelectric element and channel portions are arranged alternately, while the inlet and the outlet of the channel portions are arranged in an opposite manner on the front side and the rear side respectively (patent literatures 1 to 3).

The channel portion of such an ink jet head is of a straight type having its size and shape approximately not changed in the length direction from its inlet to its outlet, and at its rear side, an ink manifold as an ink supply room forming member making up an ink supply room for supplying ink to the channel portion is fixed; therefore, it is difficult to electrically connect a lead wire for applying a voltage to a drive electrode formed on each drive wall to a drive circuit.

For example, in a technology described in the above-mentioned patent literatures 1 to 3, through holes are formed in one of the upper and lower base plate oppositely attached to the drive walls as holding them from the upper and lower direction, and by the utilization of these through holes, lead wires connected to the respective drive electrodes are made to come out to the outer surface of the head chip; however, because the operation to form such through holes for the respective channel portions is troublesome, and on top of it, an operation for connecting lead wires from the drive circuit to the lead wires formed in these through holes is required, a structure to make it possible to carry out more simply an electrical connection with the lead wires from a drive circuit is desired.

Especially, in recent years, for the purpose of recording a higher-quality, higher-definition image, it has been progressing to make the nozzle density higher, and also it has been considered an ink jet head having a head chip structure whose nozzle density is made higher by the formation of a plurality of nozzle rows in the nozzle plate through the formation of the drive walls and the channel portions in a multi-stage manner in the vertical direction; in particular, in the case of a head chip having a structure of three or more stages stacked in the vertical direction, there has been a problem that it becomes more difficult to electrically connect lead wires for applying a voltage to the respective drive electrodes located at the middle position to a drive circuit.

Further, on the rear surface of the head chip, an ink manifold making up an ink supply room for supplying ink to each channel portion from its inlet side (the reverse side to the nozzle plate) is fixed with an adhesive; however, in the above-mentioned conventional technology, it is necessary to bond fixedly the rear surface and the ink manifold by means of a coating of an adhesive in a way such that the bonding area does not overlap each channel portion by the utilization of the space surrounding the channel portions. However, the thickness of a head chip is only several millimeters or so, and in the rear surface of such a head chip, the area for bonding capable of being coated with an adhesive to a degree not to produce a part of the adhesive being pressed out has a space of only about 0.5 mm at the largest. Hence, when an ink manifold is bonded fixedly with the rear surface of a head chip by means of an adhesive, it is necessary to carry it out with the adhesive carefully coated on a minute space in such a manner as not to be forced out, but this raises a problem in terms of productivity. In this case, also it can be considered to secure a broad coating space of an adhesive by the upper and lower base plates being formed to be larger (thicker), but it results in a head being made larger-sized uselessly. For this reason, it is desired an ink jet head having a structure to make it possible to achieve a further improved productivity without making its head chip large-sized uselessly.

[Patent literature 1] The publication of the unexamined patent application 2002-103612

[Patent literature 2] The publication of the unexamined patent application 2002-103614

[Patent literature 3] The publication of the unexamined patent application 2002-210955

Therefore, it is an object of this invention to provide an ink jet head of high productivity which makes it possible to carry out the electrical connection of the drive electrodes in the respective channel portions with lead wires from a drive circuit in a simple manner, and also makes it possible to carry out the formation of an ink supply room for supplying ink to the inside of each channel portion easily.

SUMMARY OF THE INVENTION

The above-mentioned problem can be solved by an invention having any one of the features described below.

(1) An ink jet head comprising: a head chip having drive walls made up of piezoelectric elements and channel portions alternately arranged in parallel, outlets and inlets of the channel portions being arranged in an opposite manner at a front surface and a rear surface of the head chip respectively; a top-side base plate and a bottom-side base plate each formed to have a size longer than the length of said channel portions and fixed respectively on an upper surface and on an lower surface of the head chip; an ink supply room forming member for forming an ink supply room to supply ink to each of the channel portions, said ink supply room forming member being provided on the rear surface side of the head chip between the top-side base plate and the bottom-side base plate; first lead wires to be electrically connected to their respective drive electrodes formed on the drive walls, said first lead wires being formed on a fixed surface of the head chip where the head chip is fixed to at least one of the top-side base plate and the bottom-side base plate; and second lead wires to be electrically connected to their respective first lead wires, said second lead wires being formed on the surface of at least one of the top-side base plate and the bottom-side base plate at the side of the fixed surface of the head chip.

(2) The ink jet head of (1), wherein the head chip comprises the drive walls and the channel portions, both of the drive walls and the channel portions being formed in two stages in the vertical direction.

(3) The ink jet head of (1), further comprising rear face lead wires formed on the rear surface of the head chip, wherein the first lead wires are electrically connected through the rear face lead wires to their respective drive electrodes formed on the drive walls.

(4) The ink jet head of (3), further comprising an electrode protection film being formed on the surface of the drive electrodes, the rear face lead wires, and the second connection wires.

(5) The ink jet head of (1), further comprising a flexible board equipped with a drive IC, said flexible board being electrically connected to at least one of the top-side base plate and the bottom-side base plate, on which the second lead wires are formed.

(6) The ink jet head of (1), wherein a drive IC is provided on at least one of the top-side base plate and the bottom-side base plate, on which the second lead wires are formed.

(7) The ink jet head of (1), wherein at least one of members except for the drive walls in the head chip, the top-side base plate, and the bottom-side base plate being made of any material selected from a ceramic material containing aluminum nitride as a constituent, a piezoelectric material, and a liquid crystal polymer.

(8) The ink jet head of (1), wherein thermal expansion coefficient of at least one of members except for the drive walls in the head chip, the top-side base plate, and the bottom-side base plate is the thermal expansion coefficient of the piezoelectric element ±2 ppm/° C.

(9) The ink jet head of (1), the ink supply room forming member is formed of a wall portion provided in such a manner as to enclose the rear surface of the head chip between the top-side base plate and the bottom-side base plate, and the ink supply room is formed of a space enclosed by both the top-side base plate and the bottom-side base plate and the wall portion.

(10) The ink jet head of (1), wherein third lead wires are formed on the ink supply room forming member, each of said third lead wires having the one end electrically connected to each of the second lead wires as well as the other end electrically connected to a drive circuit on the outer surface of the ink supply room forming member.

(11) The ink jet head of (10), wherein the other end of the third lead wires being made to come out to the rear face side of the ink supply room forming member, and being electrically connected with the drive circuit on the rear surface of the ink supply room forming member.

(12) The ink jet head of (10), wherein the ink supply room forming member having a projection portion jutting out rearward from both of the top-side base plate and the bottom-side base plate, and the other end of the third lead wires being electrically connected with the drive circuit on the same surface as the surface of the head chip where the head chip is fixed to the top-side base plate and/or the aforesaid bottom-side base plate.

(13) The ink jet head of (10), wherein the head chip comprises the drive walls and the channel portions formed in two stages in the vertical direction.

(14) An ink jet head comprising a plurality of ink jet heads having a feature described in (13), said plurality of ink jet heads being stacked in a multi-stage manner in the vertical direction.

(15) The ink jet head of (14), wherein a heat dissipation member is provided between any two neighboring ink jet heads of the plurality of ink jet heads stacked.

(16) The ink jet head of (2), wherein one of the top-side base plate and the bottom-side base plate is formed to have a size relatively longer than the size of the other, and extends rearward from the ink supply room forming member to form an extension portion, the extension portion being electrically connected to a drive circuit by means of the second lead wire, wherein on the surface of the other of the top-side base plate and bottom-side base plate having a relatively shorter size, third lead wires are formed at a side of a fixed surface where the head chip is fixed, each of the third lead wires having one end electrically connected to each of second lead wires and the other end electrically connected to a drive circuit on the outer surface of the ink supply room forming member.

(17) The ink jet head of (16), wherein the other end of the third lead wires being made to come out to the rear surface side of the ink supply room forming member and being electrically connected to the drive circuit on the rear surface of said ink supply room forming member.

(18) The ink jet head of (16), wherein the ink supply room forming member having a projection portion projecting rearward from the other of the top-side base plate and the bottom-side base plate having a relatively shorter size, and the other end of the third lead wires being electrically connected to the drive circuit on the same surface as the surface of the head chip to be fixed to said base plate at said projection portion.

(19) An ink jet head comprising a plurality of ink jet heads having a feature described in (16), said plurality of ink jet heads being stacked in a multi-stage manner in the vertical direction.

(20) The ink jet head of (19), wherein in any two neighboring ink jet heads of the plurality of ink jet heads, a base plate having a relatively longer size of one of the two neighboring ink jet heads is placed opposite to a base plate having a relatively shorter size of the other of the two neighboring ink jet heads, and said base plate having a relatively longer size and said base plate having a relatively shorter size are formed to have approximately the same length.

(21) The ink jet head of (19), wherein a heat dissipation member is provided between any two neighboring ink jet heads of the plurality of ink jet heads stacked.

(22) The ink jet head of (10), wherein the first lead wires being made to come out from the respective drive electrodes through at least one of the front surface and the rear surface of the head chip onto the surface of the head chip where the head chip is fixed to the top-side base plate and/or the bottom-side base plate.

(23) The ink jet head of (10), wherein an electrode protection film being formed on the surface of the drive electrodes, the first lead wires, and the second lead wires facing the ink supply room.

(24) The ink jet head of (10), wherein at least one of the members except for the drive walls in the head chip, the top-side base plate, and the bottom-side base plate being made of any material selected out of a ceramic material containing aluminum nitride as a constituent, a piezoelectric material, and a liquid crystal polymer.

(25) The ink jet head of (10), wherein the thermal expansion coefficient of at least one of the members except for the drive walls in the head chip, the top-side base plate, and the bottom-side base plate is the thermal expansion coefficient of the piezoelectric element ±2 ppm/° C.

(26) The ink jet head of (1), wherein the head chip comprises the drive walls and the channel portions, both of the drive walls and the channel portions being stacked in plural stages in the vertical direction, among the first lead wires, first lead wires to be electrically connected to the drive electrodes of the respective channel portions in a couple of stages adjacent to each other in the vertical direction of the head chip being distributed to the front surface and the rear surface respectively for each stage, and being made to come out onto the upper surface or the lower surface of the head chip, one end of those second lead wires, the other end which are electrically connected to each of first lead wires made to come out through one of the front surface and the rear surface of said head chip, being made to come out from the surface to be fixed to the head chip to the outside surface, while one end of those second lead wires, the other end of which are electrically connected to each of, among the first lead wires, those which are made to come out through the other of the front surface and the rear surface of the head chip extending rearward on the surface to be fixed to the head chip.

(27) The ink jet head of (26), wherein the third lead wires are formed on the ink supply room forming member and exposed on the surface of the head, the third lead wires being electrically connected with the other end of the second lead wires whose one end extend rearward on the surface to be fixed to the head chip.

(28) The ink jet head of (27), wherein the ink supply room forming member has a projection portion projecting rearward from the top-side base plate or the bottom-side base plate on which the second lead wires are formed on both of the outer surface and the surface to be fixed to the head chip, the other end of the third lead wires being exposed on the surface of the head in the projection portion.

(29) The ink jet head of (26), wherein an electrode protection film is formed on the surface of the drive electrodes, and the first lead wires and the second lead wires each facing the ink supply room.

(30) The ink jet head of (26), wherein at least one of the members except for the drive walls in the head chip, the top-side base plate, and the bottom-side base plate being made of any material selected out of a ceramic material containing aluminum nitride as a constituent, a piezoelectric material, and a liquid crystal polymer.

(31) The ink jet head of (26), wherein the thermal expansion coefficient of at least one of the members except for the drive walls in the head chip, the top-side base plate, and the bottom-side base plate is the thermal expansion coefficient of the piezoelectric element ±2 ppm/° C.

(32) An ink jet head comprising: a head chip having drive walls made up of piezoelectric elements and channel portions alternately arranged in parallel, outlets and inlets of the channel portions being arranged in an opposite manner at a front surface and a rear surface of the head chip respectively; a top-side base plate and a bottom-side base plate each formed to have a size longer than the length of said channel portions are fixed respectively on an upper surface and on an lower surface of the head chip in such a manner that front edge surfaces of the top-side base plate and the bottom-side base plate are in the same plane of the front surface of the head chip; an ink supply room forming member for forming an ink supply room to supply ink to each of the channel portions, said ink supply room forming member being provided on the rear surface side of the head chip between the top-side base plate and the bottom-side base plate; drive electrodes formed on each of the drive walls; front-side lead wires for electrically connecting to the drive electrodes being formed over from the front surface of the head chip to the front edge surfaces of at least one of the top-side base plate and the bottom-side base plate; and drive wires for electrically connecting to the front-side lead wires being formed on the surface of the top-side base plate and/or the bottom-side base plate said wiring base plate at the surface opposite from the surface to be fixed to the head chip.

(33) The ink jet head of (32), wherein the head chip comprises the drive walls and the channel portions, both of the drive walls and the channel portions being formed in two stages in the vertical direction.

(34) The ink jet head of (32), further comprising a flexible board equipped with a drive IC, said flexible board being electrically connected to at least one of the top-side base plate and the bottom-side base plate, on which the second lead wires are formed.

(35) The ink jet head of (32), wherein a drive IC is provided on at least one of the top-side base plate and the bottom-side base plate, on which the second lead wires are formed.

(36) The ink jet head of (32), wherein at least one of members except for the drive walls in the head chip, the top-side base plate, and the bottom-side base plate being made of any material selected from a ceramic material containing aluminum nitride as a constituent, a piezoelectric material, and a liquid crystal polymer.

(37) The ink jet head of (32), wherein thermal expansion coefficient of at least one of members except for the drive walls in the head chip, the top-side base plate, and the bottom-side base plate is the thermal expansion coefficient of the piezoelectric element ±2 ppm/° C.

(101) An ink jet head characterized by it that first connection wires (first lead wires) corresponding to their respective channel portions are formed on at least one of the upper surface and the lower surface of a head chip having drive walls made up of a piezoelectric element and channel portions alternately arranged and the outlets and the inlets of the channel portions arranged in an opposite manner on its front surface and rear surface respectively, while on at least one of the front surface and the rear surface of said head chip, second connection wires (front face lead wires and/or rear face lead wires) for electrically connecting their respective drive electrodes formed on said drive walls with said first connection wires are formed, further a wiring base plate (a top-side base plate) having drive lead wires (second lead wires) for applying a voltage to said drive electrodes on its surface and being formed to have a size longer than the length of said channel portions is fixed to said head chip in such a manner that said drive lead wires are electrically connected with said first connection wires, while a flow path base plate (a bottom-side base plate) with a size longer than the length of said channel portions is fixed on the surface of said head chip opposite to the surface fixed to said wiring base plate, an enclosure wall portion (an ink supply room forming member) is provided in such a manner as to enclose the rear surface of said head chip between said flow path base plate and said wiring base plate, and an ink supply room for supplying ink to each of said channel portions is formed at the rear surface side of said head chip of a space enclosed by said flow path base plate, said wiring base plate, and said enclosure wall portion.

(102) An ink jet head characterized by it that first connection wires corresponding to their respective channel portions are formed on at least one of the upper surface and the lower surface of a head chip having drive walls made up of a piezoelectric element and channel portions alternately arranged and the outlets and the inlets of the channel portions arranged in an opposite manner on the front surface and the rear surface respectively, while at least one of the front surface and the rear surface of said head chip, second connection wires for electrically connecting their respective drive electrodes formed on said drive walls with said first connection wires are formed, two pieces of said head chip are bonded together superposed on each other with their surfaces reverse to their surfaces on which said first connection wires are formed, further a wiring base plate having a drive lead wires for applying a voltage to said drive electrodes on its surface and being formed to have a size longer than the length of said channel portions is fixed to the surface of each of the two pieces of said head chip having said first connection wires formed in such a manner that said drive lead wires are electrically connected with said first connection wires, while an enclosure wall portion is provided in such a manner as to enclose the rear surface of said two pieces of head chip between both said wiring base plates, and an ink supply room for supplying ink to each of the channel portions is formed at the rear surface side of said two pieces of head chip of a space enclosed by both said wiring base plates and said enclosure wall portion.

(103) An ink jet head characterized by it that, on any one of the upper surface and lower surface of a head chip having drive walls which have their respective drive electrodes formed and are made up of a piezoelectric element, a channel portions alternately arranged, and the outlets and the inlets of the channel portions arranged in an opposite manner on the front surface and the rear surface respectively, a wiring base plate having drive lead wires for applying a voltage to said respective drive electrodes on its surface and being formed to have a size longer than the length of said channel is fixed in such a manner as to make said drive lead wires come to the side reverse to said head chip, front-side lead wires for electrically connecting said drive electrodes with the respective drive wires on the surface of said wiring base plate is formed over from the front surface of said head chip to the front edge surface of said wiring base plate, further on the surface of said head chip opposite to the surface fixed to said wiring base plate, a flow path base plate with a size longer than the length of said channel portions is fixed, while an enclosure wall portion is provided between said flow path base plate and said wiring base plate in such a manner as to enclose the rear surface of said head chip, and an ink supply room for supplying ink to each of the channel portions is formed at the rear surface side of said head chip of a space enclosed by said flow path base plate, said wiring base plate, and said enclosure wall portion.

(104) An ink jet head characterized by it that two head chips each having drive walls which have their respective drive electrodes formed thereon and are made up of a piezoelectric element, channel portions alternately arranged, and the outlets and inlets of the channel portions arranged in an opposite manner on the front surface and the rear surface respectively are bonded together vertically superposed on each other, and wiring base plates each having drive lead wires for applying a voltage to each of said drive electrodes on the surface and being formed to have a size longer than the length of said channel portions are fixed on the respective surfaces reverse to said superposition surfaces of the two head chips in such a manner as to make said drive lead wires come to the side reverse to their own one of said two head chips, while front-side lead wires for electrically connecting said drive electrodes with said drive lead wires on the surface of one of said wiring base plates are formed over from the front surface of one of said head chips to the front edge surface of one of said wiring base plates and front-side lead wires on the surface of the other of said wiring base plates are formed over from the front surface of the other of said head chips to the front edge surface of the other of said wiring base plates, further an enclosure wall portion is provided between said two wiring base plates in such a manner as to enclose the rear surface of said two head chips, and an ink supply room for supplying ink to each of the channel portions is formed at the rear surface side of said head chips of a space enclosed by said two wiring base plates and said enclosure wall portion.

(105) An ink jet head having a feature as set forth in the feature (101) or (102) characterized by an electrode protection film being formed on the surface of the aforesaid drive electrodes, the aforesaid second connection wires, and the aforesaid drive lead wires.

(106) An ink jet head having-a feature as set forth in any one of the features (101) to (105) characterized by a flexible board equipped with a drive IC being electrically connected to the aforesaid wiring base plate.

(107) An ink jet head having a feature as set forth in any one of the features (101) to (105) characterized by the aforesaid wiring base plate equipped with a drive IC.

(108) An ink jet head having a feature as set forth in any one of the features (101) to (107) characterized by at least one of the base plates except for the aforesaid drive walls in the aforesaid head chip, the aforesaid wiring base plate, and the aforesaid flow path base plate being made of any material selected from a ceramic material containing aluminum nitride as a constituent, a piezoelectric material, and a liquid crystal polymer.

(109) An ink jet head having a feature as set forth in any one of the features (101) to (108) characterized by the thermal expansion coefficient of at least one of the base plates except for the aforesaid drive walls in the aforesaid head chip, the aforesaid wiring base plate, and the aforesaid flow path base plate is the thermal expansion coefficient of the aforesaid piezoelectric element ±2 ppm/° C.

(110) An ink jet head characterized by it that, to the upper surface and the lower surface of a head chip having drive walls made up of a piezoelectric element and channel portions alternately arranged with the outlet and inlet of the channel portions arranged on the front side and the rear side respectively in an opposite manner, an top-side base plate and a bottom-side base plate each formed to have a size longer than the length of said channel portions are fixed respectively, an ink supply room forming member for supplying ink to each of the channel portions is provided on the rear surface of said head chip between both of said base plates, on the surface of said head chip fixed to said top-side base plate and/or said bottom-side base plate, first lead wires to be electrically connected to their respective drive electrodes each formed on each of said drive walls are formed, as regards said top-side base plate and/or said bottom-side base plate, on the surface to be fixed to said head chip, second lead wires to be electrically connected to their respective first lead wires are formed, and on said ink supply room forming member, third lead wires each having the one end electrically connected to each of said second lead wires as well as the other end electrically connected to a drive circuit on the outer surface of said ink supply room forming member are formed.

(111) An ink jet head having a feature as set forth in the feature (110) characterized by the other end of the aforesaid third lead wire being made to come out to the rear face side of the aforesaid ink supply room forming member, and being electrically connected with a drive circuit on the rear surface of said ink supply room forming member.

(112) An ink-jet head having a feature as set forth in the feature (110) characterized by the aforesaid ink supply room forming member having a projection portion jutting out rearward from both of the aforesaid base plates and the other end of the aforesaid third lead wires being electrically connected with a drive circuit on the same surface as the surface of the head chip to be fixed to the aforesaid top-side base plate and/or the aforesaid bottom-side base plate.

(113) An ink jet head having a feature as set forth in the feature (110), (111), or (112) characterized by the aforesaid head chip having the aforesaid drive walls and the aforesaid channel portions formed in two stages in the vertical direction.

(114) An ink jet head characterized by using a plurality of ink jet heads having a feature as set forth in the feature (113) and being formed of said plurality of ink jet heads stacked in a multi-stage manner in the vertical direction.

(115) An ink jet head having a feature as set forth in the feature (114) characterized by being equipped with a heat dissipation member between any two neighboring ink jet heads.

(116) An ink jet head characterized by it that, to the upper surface and the lower surface of a head chip having drive walls made up of a piezoelectric element and channel portions alternately arranged with the outlet and inlet of the channel portions arranged on the front side and the rear side respectively in an opposite manner and with said drive walls and said channel portions formed in two stages in the vertical direction of the head chip, an top-side base plate and a bottom-side base plate each formed to have a size longer than the length of said channel portions are fixed respectively, an ink supply room forming member for supplying ink to each of the channel portions is provided on the rear surface of said head chip between both of said base plates, on the surfaces of said head chip to be fixed to said top-side base plate and said bottom-side base plate respectively, first lead wires to be electrically connected to their respective drive electrodes each formed on each of said drive walls are formed, as regards said top-side base plate and said bottom-side base plate, on each of the surfaces to be fixed to said head chip, second lead wires to be electrically connected to their respective first lead wires are formed, while one of said top-side base plate and said bottom-side base plate is formed to have a size relatively longer than the size of the other, and extends rearward from said ink supply room forming member to form an extension portion to be electrically connected to a drive circuit by means of said second lead wire, and as regards said ink supply room forming member, third lead wires each having one end electrically connected to each of said second lead wires and the other end electrically connected to a drive circuit on the outer surface of said ink supply room forming member are formed on the surface to be fixed to the other of said top-side base plate and bottom-side base plate having a relatively shorter size.

(117) An ink jet head having a feature as set forth in the feature (116) characterized by the other end of the aforesaid third lead wires being made to come out to the rear surface side of the aforesaid ink supply room forming member and being electrically connected to a drive circuit on the rear surface of said ink supply room forming member.

(118) An ink jet head having a feature as set forth in the feature (116) characterized by the aforesaid ink supply room forming member having a projection portion projecting rearward from aforesaid the other of the top-side base plate and the bottom-side base plate having a relatively shorter size and the other end of the aforesaid third lead wires being electrically connected to a drive circuit on the same surface as the surface of the head chip to be fixed to said base plate at said projection portion.

(119) An ink jet head characterized by using a plurality of ink jet heads having a feature as set forth in any one of the features (116) to (118) and being formed of said plurality of ink jet heads stacked in a multi-stage manner in the vertical direction.

(120) An ink jet head having a feature as set forth in the feature (119) characterized by it that in any tow neighboring ink jet heads, the aforesaid base plate having a relatively longer size of one of said two neighboring ink jet heads is placed opposite to the aforesaid base plate having a relatively shorter size of the other of said two neighboring ink jet heads, and said base plate having a relatively longer size and said base plate having a relatively shorter size are formed to have approximately the same length.

(121) An ink jet head having a feature as set forth in the feature (119) or (120) characterized by being equipped with a heat dissipation member between any two neighboring ink jet heads stacked.

(122) An ink jet head having a feature as set forth in ant one of the features (110) to (121) characterized by the aforesaid first lead wires being made to come out from the aforesaid respective drive electrodes through at least one of the front surface and the rear surface of the aforesaid head chip onto the surface of said head chip to be fixed to the aforesaid top-side base plate and/or the aforesaid bottom-side base plate.

(123) An ink jet head having a feature as set forth in any one of the features (110) to (122) characterized by it that the aforesaid ink supply room forming member is formed of a wall portion provided in such a manner as to enclose the rear surface of the aforesaid head chip between the aforesaid top-side base plate and the aforesaid bottom-side base plate, and the aforesaid ink supply room is formed of a space enclosed by said both plates and said wall portion.

(124) An ink jet head having a feature as set forth in any one of the features (110) to (123) characterized by an electrode protection film being formed on the surface of the aforesaid drive electrodes, the aforesaid first lead wires, and the aforesaid second lead wires facing the aforesaid ink supply room.

(125) An ink jet head having a feature as set forth in any one of the features (110) to (124) characterized by at least one of the members except for the drive walls in the aforesaid head chip, the aforesaid top-side base plate, and the aforesaid bottom-side base plate being made of any material selected out of a ceramic material containing aluminum nitride as a constituent, a piezoelectric material, and a liquid crystal polymer.

(126) An ink jet head having a feature as set forth in any one of the features (110) to (125) characterized by the thermal expansion coefficient of at least one of the members except for the drive walls in the aforesaid head chip, the aforesaid top-side base plate, and the aforesaid bottom-side base plate being the thermal expansion coefficient of the aforesaid piezoelectric element ±2 ppm/° C.

(127) An ink jet head characterized by it that, on the upper surface and the lower surface of a head chip having drive walls made up of a piezoelectric element and channel portions alternately arranged, the outlets and inlets of the channel portions arranged in an opposite manner on the front surface and the rear surface respectively, and said drive walls and said channel portions formed to be stacked in plural stages in the vertical direction, an top-side base plate and a bottom-side base plate, both being formed to have a size longer than the length of said channel portions, are fixed respectively, and extend rearward from said channel portions, an ink supply room forming member for forming an ink supply-room for supplying ink to each of said channel portions is provided at the rear surface side between both said base plates, first lead wires to be electrically connected to their respective drive electrodes in said channel portions are made to come out onto the outer surface of said head chip, among said first lead wires, first lead wires to be electrically connected to the drive electrodes of the respective channel portions in a couple of stages adjacent to each other in the vertical direction of said head chip are distributed to the front surface and the rear surface for each stage and made to come out onto the upper surface or the lower surface of the head chip, further on said top-side base plate or said bottom-side base plate to be fixed to the upper surface or the lower surface of said head chip onto which said first lead wires are made to come out, second lead wires to be electrically connected to their respective first lead wires are formed, as regards said second lead wires, one end of those lead wires whose the other end are electrically connected to each of, among said first lead wires, those which are made to come out through one of the front surface and the rear surface of said head chip are made to come out from the surface to be fixed to said head chip to the outside surface, while one end of those lead wires whose the other end are electrically connected to each of, among said first lead wires, those which are made to come out through the other of the front surface and the rear surface of said head chip extend rearward on the surface to be fixed to said head chip.

(128) An ink jet head having a feature as set forth in the feature (127) characterized by the aforesaid ink supply room forming member having thereon the aforesaid third lead wires to be electrically connected with the other end of the aforesaid second lead wires whose one end extend rearward on the surface to be fixed to said head chip formed and exposed on the surface of the head.

(129) An ink jet head having a feature as set forth in the feature (128) characterized by the aforesaid ink supply room forming member having a projection portion projecting rearward from the aforesaid top-side base plate or the aforesaid bottom-side base plate on which the aforesaid second lead wires are formed on both of the outer surface and the surface to be fixed to the aforesaid head chip, and the other end of the aforesaid third lead wires being exposed on the surface of the head in said projection portion.

(130) An ink jet head having a feature as set forth in any one of the features (127) to (129) characterized by the aforesaid ink supply room forming member being formed of a side wall portion which is provided in such a manner as to enclose the rear surface of the aforesaid head chip between the aforesaid top-side base plate and the aforesaid bottom-side base plate, and the aforesaid ink supply room being formed of a space enclosed by both said plates and said side wall portion.

(131) An ink jet head having a feature as set forth in any one of the features (127) to (130) characterized by an electrode protection film to be formed on the surface of the aforesaid drive electrodes, and the aforesaid first lead wires and the aforesaid second lead wires each facing the aforesaid ink supply room.

(132) An ink jet head having a feature as set forth in any one of the features (127) to (131) characterized by at least one of the members except for the drive walls in the aforesaid head chip, the aforesaid top-side base plate, and the aforesaid bottom-side base plate being made of any material selected out of a ceramic material containing aluminum nitride as a constituent, a piezoelectric material, and a liquid crystal polymer.

(133) An ink jet head having a feature as set forth in any one of the features (127) to (132) characterized by the thermal expansion coefficient of at least one of the members except for the drive walls in the aforesaid head chip, the aforesaid top-side base plate, and the aforesaid bottom-side base plate being the thermal expansion coefficient of the aforesaid piezoelectric element ±2 ppm/° C.

BRIEF DESCRIPTION OF THE DRAWINGS

FIG. 10(*a*) and FIG. 10(*b*) are drawings each showing one process of a manufacturing method of an ink jet head;

FIG. 22(*a*) is a vertical cross-sectional view showing the essential part of an ink jet head of further another mode of the sixth embodiment, and FIG. 22(*b*) is a drawing showing the surface of the circuit board of it;

FIG. 30(*a*) is the front-view of a head chip, and FIG. 30(*b*) is the rear view of the head chip;

DETAILED DESCRIPTION OF THE PREFERRED EMBODIMENT

In the following, the embodiment of this invention will be explained with reference to the drawings.

Figure 1:
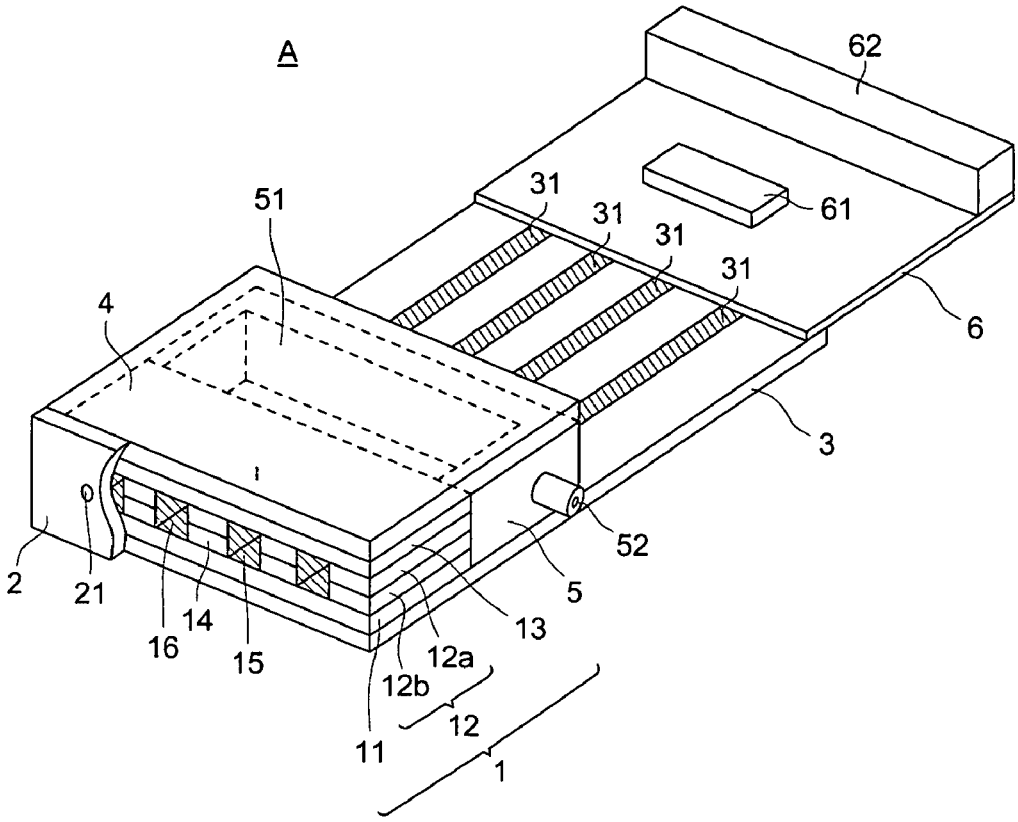
FIG. 1 is a perspective view showing the whole of an ink jet head of the first embodiment of this invention.
Figure 2:
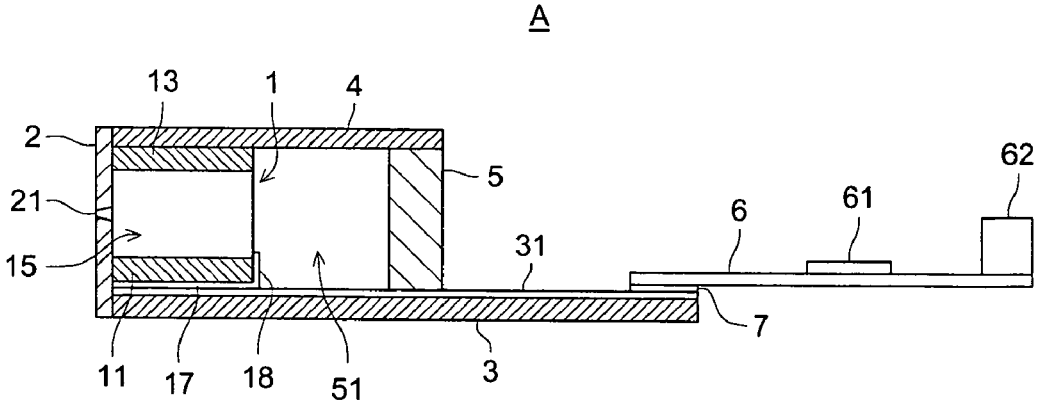
FIG. 2 is a vertical cross-sectional view of the ink jet head shown in FIG. 1.

FIG. 1 is a vertical cross-sectional view showing the whole of an ink jet head of the first embodiment of this invention, and FIG. 2 is a vertical cross-sectional view of it.

In the drawing, the sign A denotes an ink jet head, 1 denotes a head chip, 2 denotes a nozzle plate bonded to the front surface of the head chip 1, 3 denotes a wiring base plate bonded to the bottom surface of the head chip 1, 4 denotes a flow path base plate bonded to the top surface of the head chip 1, and 5 denotes an enclosure wall portion provided between the wiring base plate 3 and the flow path base plate 4.

In addition, in this specification, the surface at the side of jetting ink drops from the head chip 1 is referred to as the "front surface", and the surface at the side opposite to that is referred to as the "rear surface". Further, the outer surface located over the channel portions provided in an array in the head chip 1 is referred to as the "upper surface" and the outer surface located under them is referred to as the "lower surface", with the channel portions located in between.

The head chip 1 has drive walls 14 made up of a piezoelectric element 12 and channel portions 15 alternately arranged between an upper base plate 13 and a lower base plate 11. In the example shown in the drawing, one having four channel portions 15 and five drive walls 14 formed therein is shown as an example. The above-mentioned channel portions 15 each have a shape such that both the side walls are directed vertically and are parallel to each other. Further, each of the channel portions is of a straight type with the size and shape approximately not changed in the direction along its length from the inlet to the outlet. Owing to the channel portions 15 each being made to be of a straight type in this manner, it is possible to obtain an ink jet head which has a good bubble removing ability, has a high power efficiency, generates only a small amount of heat, and has a good response to high speeds.

For the piezoelectric material to be used in the piezoelectric element 12, a piezoelectric material known to the public which produces a deformation by the application of a voltage can be used, and a base plate made of an organic material, a base plate made of a non-metal, etc. can be cited. In particular, a piezoelectric-material base plate made of a non-metal is desirable, and there are a piezoelectric ceramic base plate to be formed through processes such as molding and baking, a base plate to be formed without requiring a molding and baking, etc.

Among the piezoelectric-material base plates made of a non-metal, as regards the piezoelectric ceramic base plate to be formed through processings such as molding and baking, lead zirconate titanate (PZT) is desirable. Further, also it is appropriate to use $BaTiO_3$, ZnO, $LiNbO_3$, $LiTaO_3$, etc.

For the PZT, PZT($PbZrO_3$-$PbTiO_3$) and PZT with a third constituent added can be cited. For the third constituent to be added, $Pb(Mg_{1/2}Nb_{2/3})O_3$, $Pb(Mn_{1/3}Sb_{2/3})O_3$, $Pb(Co_{1/3}Nb_{2/3})O_3$, etc. can be cited.

Further, among the piezoelectric material base plates made of a non-metal, as regards a base plate to be formed without requiring molding and baking, it can be formed, for example, by a sol-gel process, a stacked layer coating method, etc.

The piezoelectric element 12 is formed of two sheets of piezoelectric material plate 12*a* and 12*b* bonded together with the polarization orientation directed reversely to each other. In this way, by a plurality of groove being arranged in an array in the piezoelectric element 12, the drive walls 14 having the polarization orientations directed reversely to each other are formed.

For the means for bonding the piezoelectric material base plates 12*a* and 12*b* together, a bonding method using an adhesive can be adopted; however, the method is not limited to this, so long as it is capable of bonding them. In the case of bonding using an adhesive, it is desirable to make the thickness of the adhesive after setting fall within a range of 1 μm to 10 μm.

In addition, although it is not shown in the drawings, also it is appropriate to form drive walls 14 similar to the above-mentioned ones, by a piezoelectric-material base plate 12*b* being made thick instead of the lower base plate 11, and by the formation of a plurality of parallel grooves having a depth from the upper side of the upper piezoelectric-material base plate 12*a* up to the vertically middle position of the piezoelectric-material base plate 12*b*.

On each of the drive walls 14, a drive electrode 16 is formed facing the inside of the channel portion 15. For the metal for forming the drive electrode 16, Ni (nickel), Co (cobalt), Cu (copper), Al (aluminum), etc. can be cited; Ni and Cu are desirable, and particularly, Ni is preferable.

For the formation of the drive electrodes 16, an evaporation coating method, a sputtering method, a plating method, a CVD method (Chemical Vapor phase Deposition method), etc. can be cited; a plating method is desirable, and in particular, a method of forming the drive electrodes by an electroless plating process is desirable. By an electroless plating method, a uniform metallic film free of pin holes can be formed.

In an electrode formation process based on an electroless plating, it is appropriate to use a Ni—P plating method or a Ni—B plating method singly, or also it is appropriate to have a Ni—P plating layer and a Ni—B plating layer superposed. Because a Ni—P plating layer comes to have a higher electrical resistivity with the higher P content, a P content of 1% to several % is desirable. As regards the B content in a Ni—B plating layer, it is usually 1% or under; this makes the Ni content in a Ni—B plating layer higher than that of Ni—P plating layers, the electrical resistivity lower, and the bonding ability to a lead wire at the outside better; therefore, Ni—B is preferable to Ni—P, but because Ni—B is of high cost, it is desirable to combine Ni—P with Ni—B. Further, also it is appropriate to form an Au (gold) layer as an over-layer by an electroless plating method or a evaporation coating method on a Ni—P or Ni—B plating layer as an under-layer. As regards the thickness of the plating film, a thickness falling within a range of 0.5 pm to 5 μm is desirable.

On at least one of the upper surface and the lower surface of the head chip 1, first connection wires (first lead wires) 17 of the same number as the number of the channel portions 15 are formed parallel to one another with the same pitch as the channel portions 15, and extend from the front surface to the rear surface of the head chip 1 (refer to FIG. 10(*a*) and FIG. 10(*b*)). In this example, the connection wires are formed only on the lower surface of the head chip 1; however, they may be formed on the upper surface of the head chip 1, or on both the upper and lower surfaces. As regards these first connection wires 17, although the detail will be described later, because they are electrically connected to drive lead wires (second lead wires) 31 of the wiring base plate 3 for applying a voltage from a drive circuit to the respective drive electrodes 16, if they are formed on both the upper and lower surfaces, the above-mentioned connection to the drive lead wires 31 can be made from any one of the upper surface and the lower surface of the head chip 1. That is, because the wiring base plate 3 can be bonded to any one of the upper surface and the lower surface of the head chip 1, it is not necessary to select the direction of the head chip 1, which is advantageous in terms of production of ink jet heads.

Further, on at least one of the front surface and the rear surface of the head chip 1, second connection wires 18 whose one end are electrically connected to the respective drive electrodes 16 formed on the drive walls 14 in the channel portions 15 are formed, and the other end of them are electrically connected to the corresponding first connection wires respectively. Accordingly, the lead wires to be electrically connected to the respective drive electrodes 16 formed on the drive walls 14 in the channel portions 15 are made to come out through the second connection wires 18 along the ways from the rear surface of the head chip 1 to the lower surface of the head chip 1. In the example shown in the drawing, the second connection wires are formed only on the rear surface of the head chip 1; however, they may be formed only on the front surface of the head chip 1, or on both the front and rear surfaces.

The wiring base plate 3 is made up of a board which has a width approximately the same as the width of the head chip 1 (the length in the direction of the arraying of the channel portions 15), and has a length sufficiently longer than the length of the head chip 1 (the length from the front surface to the rear surface of the head chip 1), and on its surface, with the same pitch as the channel portions 15 of the head chip 1, there are formed drive lead wires 31 for applying a voltage supplied from a drive circuit (not shown in the drawing) to their respective drive electrodes 16 formed on the drive walls 14 in the channel portions 15.

This wiring base plate (top-side base plate) 3 is fixed to the head chip 1, in this case, to the lower surface of the head chip 1 in such a way that its front edge surface comes to be flush with the front surface of the head chip 1, and its surface on which the drive lead wires 31 are formed is made to face the first connection wires 17, in order that the drive lead wires 31 can be electrically connected to their respective first connection wires 17.

The flow path base plate (bottom-side base plate) 4 is formed of a base plate which has a width approximately the same as the width of the head chip, is a little shorter than the above-mentioned wiring base plate 3, and is sufficiently longer than the length of the head chip 1, and is fixed to the surface of the head chip 1 at the side opposite to the surface to be bonded to the above-mentioned wiring base plate 3, that is, to the upper surface of the upper base plate 13 in this case in such a manner that its front edge surface comes to be flush with the front surface of the head chip 1.

The enclosure wall portion (ink supply room forming member) 五is a side wall forming member provided in such a manner as to enclose the rear surface of the above-mentioned head chip 1 between these wiring base plate 3 and flow path base plate 4 presenting a U-shape in the plan view, and is formed of high-function resin called engineering plastic such as polyimide, polycarbonate, or the like. By this, at the rear surface side of the head chip 1, there is formed a space which is covered by the flow path base plate 4 and the wiring base plate 3 for its upper and lower side and enclosed by the enclosure wall portion 5 for its left and right sides, and of this space, an ink supply room 51 for supplying ink to each of the channel portions 15 is made up. The sign 52 denotes an inlet for letting ink flow into the ink supply room 51, and by this, the ink supply room functions as an ink manifold. Although not shown in the drawing, this ink supply room 51 has a filter for preventing the flowing-in of dusts inside.

The nozzle plate 2 has a size such that it covers the area ranging from the front edge of the above-mentioned flow path base plate 4 to the front edge of the wiring base plate 3 and is fixed to the front surface side of the head chip 1 having the flow path base plate 4 and the wiring base plate 3 fixed to its upper surface and lower surface respectively. In the nozzle plate 2, nozzle holes 21 corresponding to their respective channel portions 15 are opened.

With this ink jet head A, a flexible board 6 equipped with a drive IC 61 is bonded by means of an anisotropic conductive film 7 in such a way that its lead wires are electrically connected to the respective drive lead wires on the surface of the wiring base plate 3. The sign 62 denotes a connector for making an electrical contact with external wiring. A drive voltage from a drive circuit (not shown in the drawing) is inputted to the drive IC 61 through the connector 62, and is applied from said IC 61 through the drive lead wires 31, the first connection wires 17, and the second connection wires 18 to each of the drive electrodes 16.

In this ink jet head A, it is practiced that the lead wires for applying a voltage to each of the drive electrodes 16 are made to come out to the outer surface of the head chip 1 through the first connection wires 17 and the second connection wires 18, and only by the bonding of them to the drive lead wires 31 formed on the wiring base plate 3, it is possible to carry out the electrical connection with the lead wires from the drive circuit extremely easily, and it is unnecessary to form complex wiring such as the formation of through holes corresponding to the respective channel portions 15 as has been heretofore done.

Further, because the ink supply room 51 for practicing ink supply to each of the channel portions 15 is formed of the enclosure wall portion 5 which is fixed in such a manner as to enclose the rear surface of the head chip 1 between the flow path base plate 4 and the wiring base plate 3, the fixing portion of the head chip 1 to the ink supply room 51 is only an area that is composed of the rear surface of the wall portions located at both the side edge portions and an extremely small area of the upper base plate 13 and the lower base plate 11 adjacent to the above-mentioned rear surface of the wall portions. Accordingly, it is unnecessary to fix an ink manifold even to the whole area of the upper base plate 13 and the lower base plate 11 so as to enclose the channel portions 15 as has been heretofore done; therefore, neither it is necessary to secure a bonding area for fixing an ink manifold over the whole area of the upper base plate 13 and the lower base plate 11, nor it is necessary to coat an adhesive over the whole area of said upper base plate 13 and lower base plate 11. Owing to this, neither it is necessary to form the head chip 1 to have a large size uselessly for forming the ink supply room 51 as a conventional one, nor it is necessary to practice a coating operation with an adhesive onto a minute space, and it is possible to achieve an improvement of productivity.

In this invention, it is desirable that at least one of the base plates except for the drive walls 14 in the head chip 1, namely in this embodiment, both the base plates of the upper base plate 13 and the lower base plate 11, the wiring base plate 3, and the flow path base plate 4 is made of any material selected out of a ceramic material containing aluminum nitride as a constituent, a piezoelectric material, and a liquid crystal polymer. By this, it is given an effect that an ink jet head which has an excellent heat dissipation property and is stable against temperature variation can be obtained.

Further, it is more desirable that the thermal expansion coefficient of at least one of the base plates except for the drive walls 14 in the head chip 1, the wiring base plate 3, and the flow path base plate 4 is the thermal expansion coefficient of the piezoelectric element 12 making up the drive walls 14 ±2 ppm/° C. By the thermal expansion coefficient being made to fall within this range, separation etc. between the base plates due to the difference in the thermal expansion coefficient are not produced.

In the ink jet head A shown in this first embodiment, because the second connection wires 18 and a part of the drive lead wires 31 face the ink supply room 51, these become in direct contact with the ink in the same way as the drive electrodes 16 in the channel portions 15. Accordingly, in the case where an aqueous ink is used for the ink, an electrode protection film is formed on the surface of the drive electrodes in the channel portions 15, the second connection wires 18, and the drive lead wires 31. For the electrode protection film, an organic insulating film such as a parylene film is desirable because it improves much more the durability of the drive electrodes 16.

Next, an example of the manufacturing method of this ink jet head A will be explained with reference to FIG. 3 to FIG. 10. In addition, the numerical figures described in the following are only an example, and this invention is not to be limited to these numerical figures.

Figure 3:
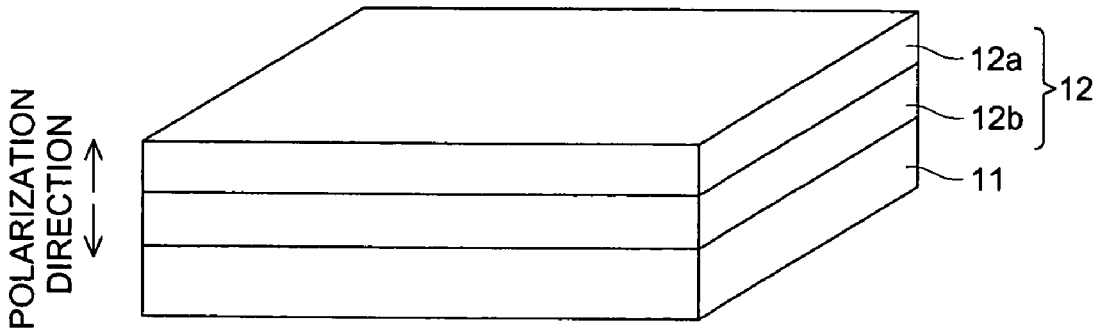
FIG. 3 is a drawing showing one process of a manufacturing method of an ink jet head.

First, as shown in FIG. 3, it is prepared a stacked-layer body made up of the piezoelectric element 12 formed of the two piezoelectric-material base plates (PZT) 12*a* and 12*b* stacked each having a thickness of 0.1 mm and a polarization (shown by the arrow marks) directed reversely to each other bonded to the lower base plate 11 (size: 50 mm square) made of a ceramic base plate having a thickness of 0.6 mm. In addition, the lower base plate 11 and the piezoelectric material base plate 12*b* may be one and the same, and in this case, the stacked-layer body is made up of two piezoelectric-material base plates with their polarization directions reversed to each other.

Figure 4:
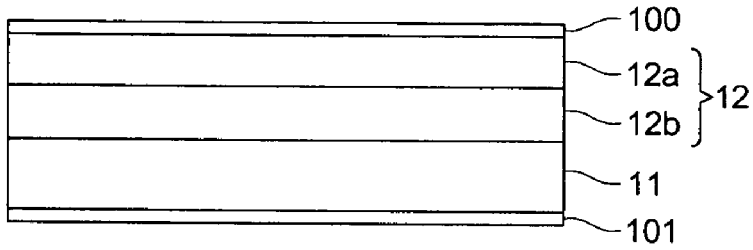
FIG. 4 is a drawing showing one process of a manufacturing method of an ink jet head;.

Next, as shown in FIG. 4, on both the upper and lower surfaces of this stacked-layer body, positive resist films 100 and 101 are coated respectively, and after that, the positive resist film 101 coated on the lower surface of the lower base plate 11 located at the side opposite to the piezoelectric element 12 is exposed by means of a stripe-shaped mask (mask width: 0.7 mm, pitch: 0.141 mm), and developed; thus, a stripe pattern of the width 0.71 mm is obtained on said lower surface.

Figure 5:
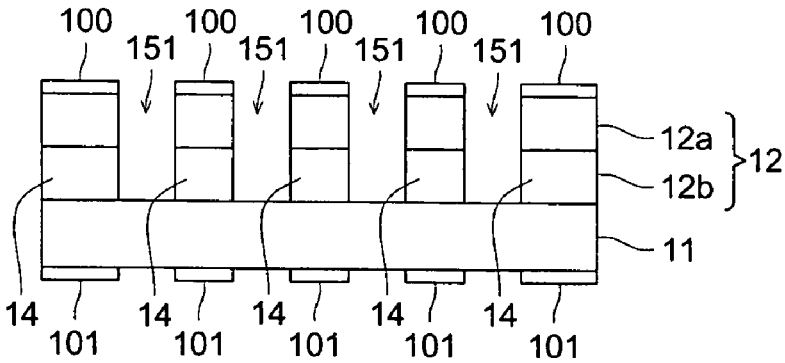
FIG. 5 is a drawing showing one process of a manufacturing method of an ink jet head.

Subsequently, as shown in FIG. 5, by means of a disk-shaped grindstone (a dicing blade) having a thickness of 0.08 mm, grooves 151, 151, - - - parallel to one another are formed with a pitch of 0.141 mm by grind working from the side of the above-mentioned piezoelectric element 12. These grooves 151 each have an approximately uniform depth (0.20 mm) along their length direction, and are straight grooves having the cross-sectional shape approximately not changed along the length direction. As regards the number of the grooves to be worked, for example, if the working of 258 stripes are carried out, 257 drive walls 14, 256 grooves 151 for the channel portions, and one remainder groove 151 at each of both sides are formed.

After that, a metal layer is formed inside each of the grooves 151 and on the lower surface of the lower base plate 11 having the above-mentioned stripe pattern formed, to become a thin film having a thickness of 0.5 pm to 5 μm by an electroless plating method. The metal layer is made to have a stacked-layer structure composed of the lower Ni—B plating layer and the upper gold plating layer. At this time, by a suitable preliminary processing being carried out prior to the electroless plating processing, what is called a selection plating in which plating metal is not deposited on the resist film is to be carried out.

Subsequently, by the removal of the resist being dissolved with a remover, the drive electrodes 16 made up of a plating layer are formed on the inner surface of their respective grooves 151, and on the upper surface of the drive walls 14, no electrode is formed; further, on the lower surface of the lower base plate 11, a plating layer is formed at each of the void portions of the stripe pattern; this produces a state shown in FIG. 6 in which the first connection wires 17 are formed.

Up to now, an example in which a selection plating method using a resist coating is carried out is shown as a method of forming the drive electrodes 16 and the first connection wires 17 by a plating method; however, this invention is not to be limited to this, but by means of another method, that is, a lift-off method, in which a dry film resist is used in place of a positive resist, and after an aluminum film is formed over the whole surface by vacuum evaporation coating, the aluminum film on the soluble part of the dry film resist is removed together with the dry film resist with a solvent, the pattern of the drive electrodes 16 and the first connection wires 17 similar to the above-mentioned ones can be also formed. At this time, it is desirable to deposit a gold film by evaporation coating successively on the aluminum layer.

Figure 7:
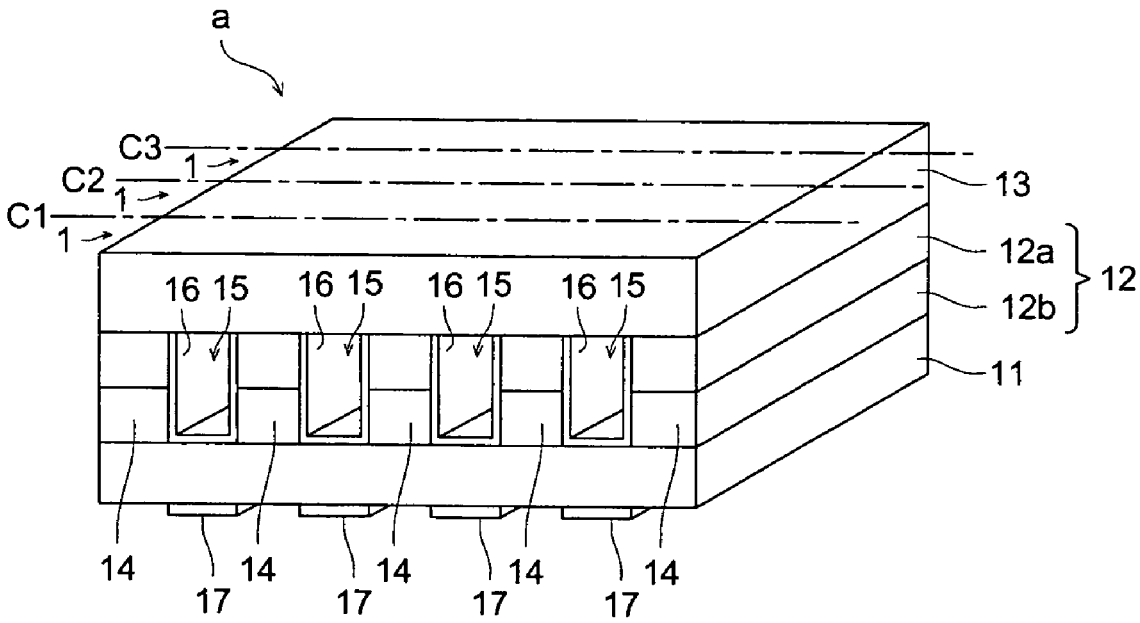
FIG. 7 is a drawing showing one process of a manufacturing method of an ink jet head.

After the drive electrodes 16 and the first connection wires 17 are formed, the upper base plate 13, which is prepared separately, is bonded to the upper surface of the drive walls 14 made up of the piezoelectric element 12 with an epoxy adhesive. FIG. 7 shows the state after the upper base plate 13 has been bonded. By this, it is formed a head base plate a having the drive walls 14 and the channel portions 15 formed of the grooves 151 arranged alternately between the upper base plate 13 and the lower base plate 11.

Next, as shown in FIG. 7, this head base plate a is cut along the cut lines C1, C2, C3, - - - which are approximately perpendicular to the length direction of the channel portions 15, and a plurality of head chips 1, 1, 1, - - - is produced from one head base plate a.

Figure 8:
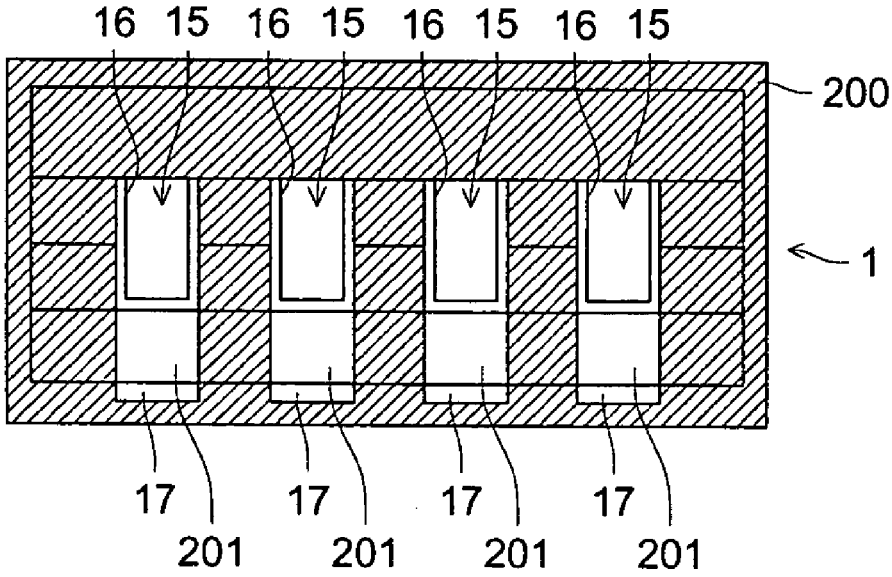
FIG. 8 is a drawing showing one process of a manufacturing method of an ink jet head.
Figure 9:
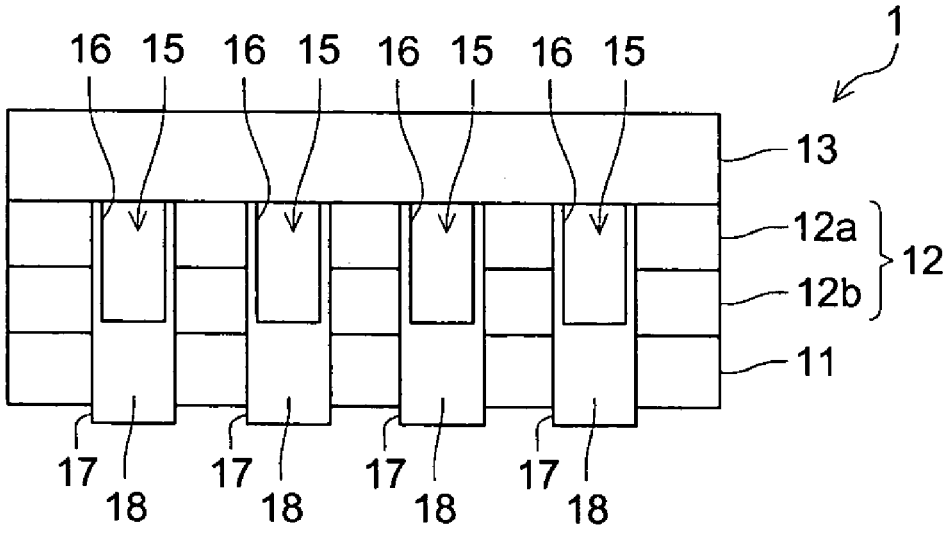
FIG. 9 is a drawing showing one process of a manufacturing method of an ink jet head.

On the cut surface of the head chip 1 produced, as shown in FIG. 8, a patterning process is carried out by means of a dry film 200 having openings 201 for forming the second connection wires corresponding to the respective channel portions 15, and after that, through the evaporation coating of an aluminum film, the second connection wires 18 are formed. In order to make certain the electrical connection with the drive electrodes 16 and the first connection wires 17, evaporation coating is carried out twice with the direction changed. In addition, as regards the method of forming the second connection wires 18 in this process, it is not limited to an evaporation coating method, but a sputtering method is also appropriate. After that, by the removal of the dry film and the aluminum film formed on it with a solvent, the head chip is brought in the state shown in FIG. 9 in which the drive electrodes 16 are electrically connected with their respective first connection wires 17 through the second connection wires 18.

Besides, in this example, an aluminum film is coated by evaporation coating on the cut surface of one side of the head chip 1 (the surface to become the rear surface of the head chip 1 later); however, it may be coated on the surface of the opposite side, or on the surface of both the front and rear sides.

A wiring base plate 3 having the drive lead wires 31 formed on its surface with the same pitch as the channel portions 15 is separately prepared. As regards the method of forming the wiring base plate 3, on a base plate having a thickness of 0.6 mm (size: approximately 50 mm square), a Cu film, a Ni film, and an Au film are formed as the wiring material in this order by plating. For the wiring base plate 3, the base plate of about 50 mm square is cut into halves, to come to have a width of 25 mm and a length of 50 mm.

Subsequently, as shown in FIG. 10(*a*) and FIG. 10(*b*), the head chip 1 and the wiring base plate 3 are fixed to each other by the bonding with an epoxy adhesive, with the first connection wires 17 and the drive lead wires 31 made to face each other. The first connection wires 17 of the head chip 1 and the drive lead wires 31 of the wiring base plate 3 are attracted to each other by the tension force of the adhesive, and a satisfactory electrical connection can be obtained. In addition, for the method of bonding the wiring base plate 3, in addition to a method using an adhesive, a method using an anisotropic conductive film, a method using a solder, a method using a conductive adhesive, etc. can be adopted.

After that, a flow path base plate 4 is fixed to the surface of the head chip 1 opposite to the wiring base plate 3. In the case where an aqueous ink is used for the ink, in the state such that the wiring base plate 3 and the flow path base plate 4 are fixed in this way, a parylene film is formed as an electrode protection film to have a thickness of 5 μm by a CVD method for example.

Subsequently, a nozzle plate 2 having nozzle holes 21 formed at the positions corresponding to the respective channel portions 15 is bonded to the surface area consisting of the front surface of the head chip 1, the front edge surface of the wiring base plate 3, and the front edge surface of the flow path base plate 4, and at the rear surface side of the head chip 1, an enclosure wall portion 5 is provided between the wiring base plate 3 and the flow path base plate 4 in such a manner as to enclose the rear surface of the head chip 1, to form an ink supply room 51. After that, to the wiring base plate 3, a flexible board 6 equipped with a drive IC 61 is bonded by means of an anisotropic conductive film 7 (refer to FIG. 1 and FIG. 2).

Figure 11:
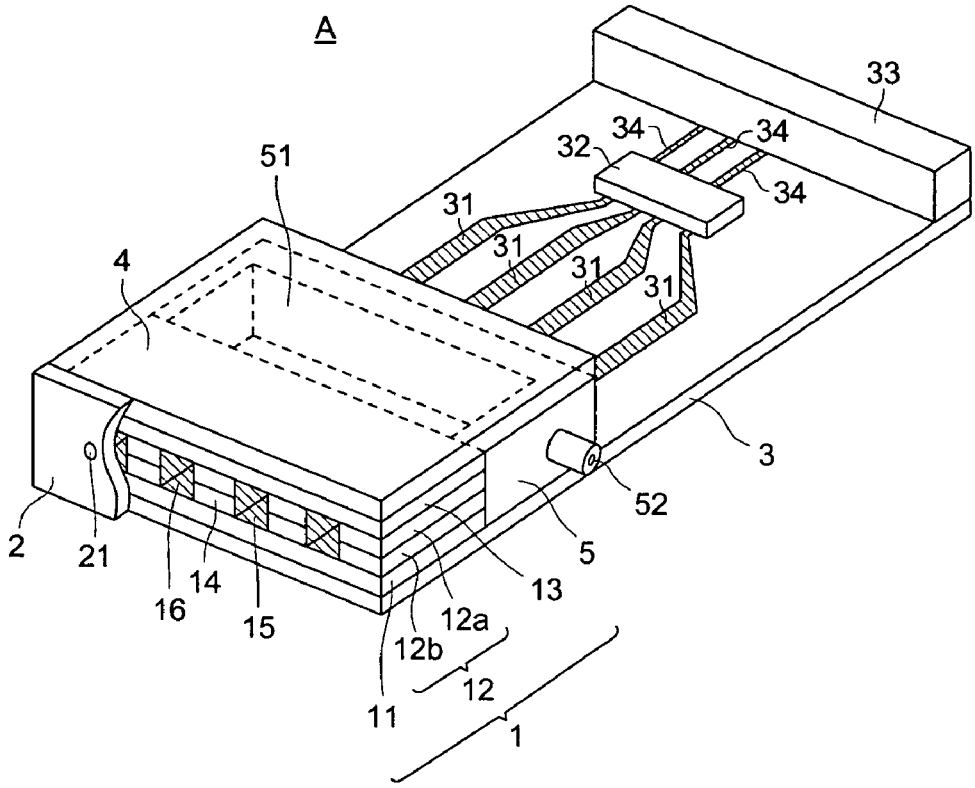
FIG. 11 is a perspective view showing the whole of an ink jet head of another mode of the first embodiment of this invention.

In the above explanation, a mode of the embodiment in which a flexible board equipped with a drive IC 61 is bonded to the wiring base plate 3 has been shown as an example; however, as another mode of the first embodiment, as shown in FIG. 11, also it is appropriate to install a drive IC 32 on the surface of the wiring base plate 3. The sign 33 denotes a connector for making a connection with external equipment, and 34 denotes lead wires for electrically connecting said connector 33 with the drive IC 32. For the method of installing the drive IC 32, methods used in a usual installment process such as a wire bonding method and a flip-chip installment method using a bump can be adopted.

In this case, as described above, an operation for separately bonding a board equipped with a drive IC can be omitted, and on top of it, also the structure can be simplified, which makes it possible to make up an extremely compact ink jet head. Further, for some kind of ink to be jetted, it is necessary to heat the ink, and for this purpose, it is necessary to provide a heater on the wiring base plate 3 or at a position adjacent to the wiring base plate 3. However, if the wiring base plate 3 is equipped with the drive IC 32 in this way, also it is possible to use the heat generating drive IC 32 as a heating means for ink.

Figure 12:
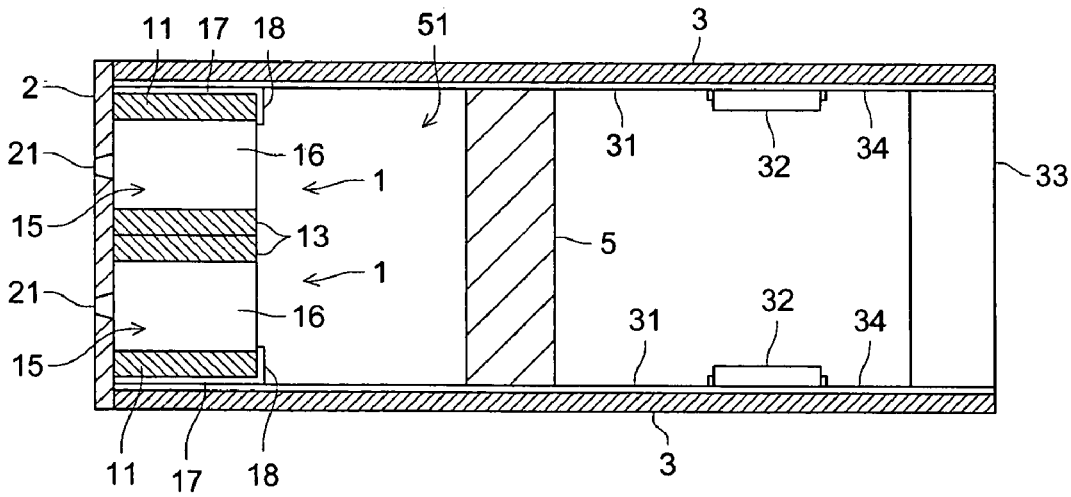
FIG. 12 is a perspective view showing the whole of an ink jet head of the second embodiment.

Next, an ink jet head of the second embodiment of this invention will be explained. FIG. 12 is a vertical cross-sectional view showing an ink jet head B of the second embodiment. The items indicated by the same sign as those of the first embodiment represent the same structure, and detailed explanation of them will be omitted unless they have a difference particularly.

An ink jet head B is composed of two head chips 1 superposed each having a structure similar to the one explained in the above-mentioned first embodiment of this invention. However, in this embodiment, first connection wires corresponding to their respective drive electrodes 16 in channel portions 15 are formed on any one of the upper surface or the lower surface of the respective head chips 1, in this case, on the surface at the side of lower base plate 11 of the respective head chips 1. It may be appropriate if second connection wires 18 to be electrically connected to these first connection wires 17 are formed on at least one of the front surface and the rear surface of the head chips 1 and 1 each.

To each of the head chips 1 and 1, on the surface having the first connection wires 17 formed, there is fixed a wiring base plate 3 having drive lead wires 31 for applying a voltage to the respective drive electrodes 16 of the corresponding head chip 1 in such a manner that the drive lead wires 31 are electrically connected to the respective first connection wires 17; further, the two head chips 1 and 1, having their respective wiring base plates 3 and 3 fixed, are fixed to each other at the surfaces opposite to their surfaces on which the wiring base plate 3, in this case, with their upper base plates 13 superposed on each other. In this ink jet head B, because the wiring base plates 3 and 3 are arranged on both the upper and lower surfaces of bonded body composed of the head chips 1 and 1 superposed, a flow path base plate 4 is not required.

Further, by an enclosure wall portion 5 being provided between the two wiring base plates 3 and 3 in such a way as to enclose the rear surface of the two head chips 1 and 1 commonly, an ink supply room 51 for supplying ink to each of the channel portions 15 of the two head chips 1 and 1 are formed.

A nozzle plate 2 has a size extending over the whole of the front surface of the two head chips 1 and 1 and the front edge surface of the tow wiring base plates 3 and 3, and nozzle holes 21 are formed on it in such a manner as to correspond to their respective channel portions 15.

Here it is shown a mode of the embodiment in which, on the surfaces each lying at the side of the wiring base plates 3 and 3 having the drive lead wires 31 formed, their respective drive IC's 32 and 32 are provided and connected to a connector 33 through the lead wires 34 and 34 respectively; however, also it is appropriate a mode in which flexible boards 6 and 6 each equipped with a drive IC 61 are separately bonded as shown in FIG. 1 and FIG. 2.

According to this ink jet head B of the second embodiment, it is possible to easily make a stacked-layer structure, only by the superposing of the head chips 1 and 1 having their respective wiring base plates 3 and 3 fixed, and it is possible to simply make up an ink jet head having a twice number of nozzles. On top of it, the electrical connection of the drive electrodes 16 of the head chips 1 and 1 with the respective drive lead wires 31 can be also made extremely easily as in the case of the first embodiment.

Besides, in this ink jet head B, also it is possible to substitute the two base plates located at the bonding plane of the head chips 1 and 1 superposed (the upper base plates 13 and 13 in this example) by a single base plate which is used commonly in the upper and lower head chips 1 and 1; this makes it possible to achieve the reduction of the number of the parts.

Further, it is also appropriate to produce head chips in the order such that, after the two head base plates a and a are bonded together, in the same way as shown in FIG. 7, the bonded body is cut at the cut lines C1, C2, and C3 to become head chips, and wiring base plates 3 and 3 are fixed to them.

Figure 13:
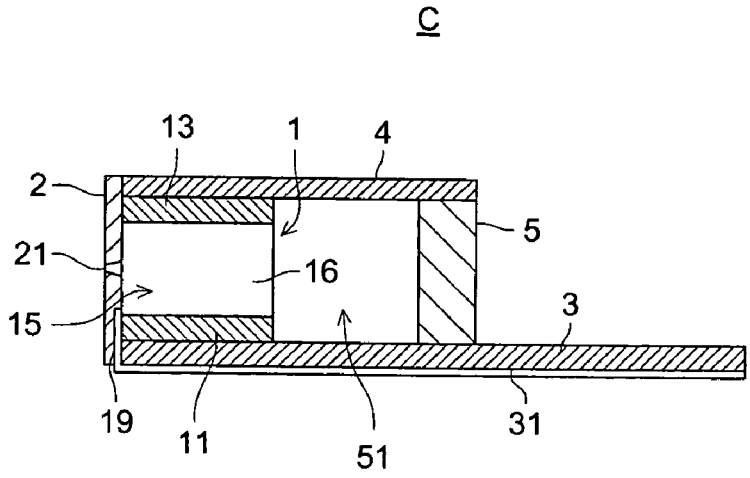
FIG. 13 is a perspective view showing the whole of an ink jet head of the third embodiment.

Next, an ink jet of the third embodiment of this invention will be explained. FIG. 13 is a vertical cross-sectional view showing an ink jet head C of the third embodiment. The items indicated by the same sign as those of the first embodiment represent the same structure, and detailed explanation of them will be omitted unless they have a difference particularly.

On this ink jet head C of the third embodiment, connection wires equivalent to the first connection wires 17 and the second connection wires 18 in the ink jet head A of the first embodiment of the invention are not formed. To a head chip 1, a wiring base plate 3 having drive lead wires 31 for applying a voltage to their respective drive electrodes 16 formed on its surface is fixed in such a manner as to make said drive lead wires 31 come to the side opposite to the head chip 1, and front lead wires 19 for electrically connecting the drive electrodes 16 to the respective drive lead wires 31 on the surface of the wiring base plate 3 are formed over the surface area covering a part of the front surface of the head chip 1 and the front edge surface of the wiring base plate 3.

In this ink jet head C, the drive electrodes 31 and the front lead wires 19 electrically connected with those can be formed at a single stroke in such a way that, after the wiring base plate 3 is fixed to the head chip 1, for example as shown in FIG. 8, patterning is carried out on the front surface of the head chip 1 and the surface of the wiring base plate 3 (the surface opposite to the surface fixed to the head chip 1) by means of a dry film, and then aluminum is coated by evaporation coating. For this reason, the manufacturing process can be simplified, and the manufacturing cost reduction can be achieved. On top of it, because there is no lead wires in the ink room 51, except for the drive electrodes 16 in the channel portions 15, in the case where an aqueous ink is used, only it is required to form an electrode protection film only on the drive electrodes to become in direct contact with ink. Accordingly, the probability that the electrodes corrode and become down owing to a defect of the electrode protection film becomes lower, which makes it possible to further improve the reliability.

Besides, although not shown in FIG. 13, it is also appropriate to bond a flexible board 6 equipped with a drive IC 61 to the wiring base plate 3 as shown in FIG. 1 and FIG. 2, or also it is appropriate to directly install a drive IC 32 on the wiring base plate 3 in the same way as shown in FIG. 11 to make it possible to carry out an electrical connection with external equipment by means of a connector 33.

Figure 14:
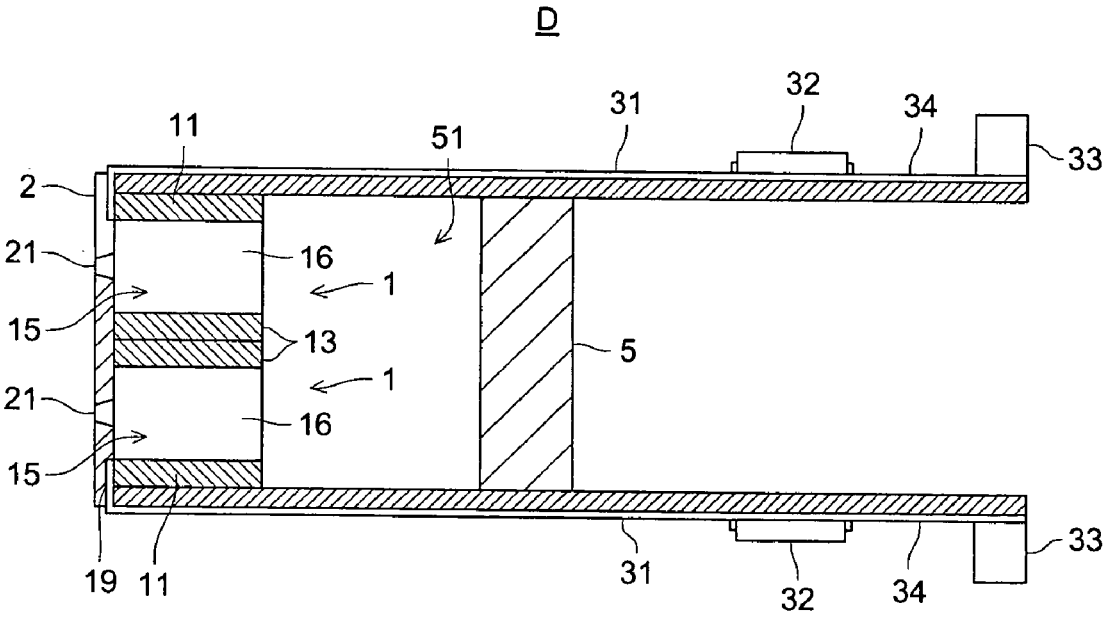
FIG. 14 is a perspective view showing the whole of an ink jet head of the fourth embodiment.

Next, an ink jet head of the fourth embodiment of this invention will be explained. FIG. 14 is a vertical cross-section view showing an ink jet head D of the fourth embodiment. The items indicated by the same sign as those of the first, second, and third embodiments are supposed to represent the same structure, and detailed explanation of them will be omitted unless they have a difference particularly.

The ink jet head D of the fourth embodiment is composed of two combinations of a head chip 1 and wiring base plate 3 superposed having the structure as those explained in the above-mentioned third embodiment.

That is, to the head chips 1 and 1, their respective wiring base plates 3 and 3 each having drive lead wires 31 for applying a voltage to the respective drive electrodes 16 of the head chip 1 formed on it are fixed in such a way that said drive lead wires 31 come to the side opposite to the head chip 1, and front lead wires 19 for electrically connecting the drive electrodes 16 to the respective drive lead wires 31 on the surface of the wiring base plates 3 and 3 are formed over the surface area covering a part of the front surface of the head chips 1 and 1 and the front edge surface of the wiring base plates 3 and 3.

Further, by an enclosure wall portion 5 being provided between the two wiring base plates 3 and 3 in such a way as to enclose the rear surface of the two head chips 1 and 1 commonly, an ink supply room 51 for supplying ink to each of the channel portions 15 of the two head chips 1 and 1 are formed.

A nozzle plate 2 has a size extending over the whole of the front surface of the two head chips 1 and 1 and the front edge surface of the tow wiring base plates 3 and 3, and nozzle holes 21 are formed on it in such a manner as to correspond to the respective channel portions 15.

According to this ink jet head D of the fourth embodiment of this invention, by the head chips 1 and 1 each having wiring base plates 3 fixed being superposed on each other and the formation of the front lead wires 19, it is possible to make up an ink jet head of a stacked-layer type which makes it possible to carry out an electrical connection of the drive electrodes 16 of the head chips 1 and 1 with the respective drive lead wires 31 extremely easily. On top of it, because the wiring base plates 3 and 3 are arranged on the upper surface and the lower surface of the layer-stacked body composed of the head chips 1 and 1 superposed respectively, a flow path base plate 4 is not required, which makes it possible to reduce the number of the parts. Further, also it is possible to substitute the two base plates located at the bonding plane of the head chips 1 and 1 superposed (the upper base plates 13 and 13 in this example) by a single base plate which is used commonly in the upper and lower head chips 1 and 1; this makes it possible to achieve the further reduction of the number of the parts.

Further, in the same manner as the third embodiment, because there is no lead wires in the ink room 51, in the case where an aqueous ink is used, only it is required to form an electrode protection film only on the drive electrodes 16 to become in direct contact with ink; therefore, the probability that the electrodes corrode and become down owing to a defect of the electrode protection film becomes lower, which makes it possible to further improve the reliability.

In addition, here it is shown a mode of the embodiment in which on the surface of the wiring base plates 3 and 3 at the side having the drive lead wires 31 formed, their respective drive IC's 32 and 32 are provided and connected to the connectors 33 and 33 through the lead wires 34 and 34 respectively. In this embodiment, because the drive IC's 32 and 32 face to the respective directions reverse to each other, it is possible to dissipate the heat generated by the drive IC's 32 and 32 effectively to the outside. Of course, also it is appropriate to bond flexible boards 6 and 6 each equipped with a drive IC 61 to their respective wiring base plates 3 and 3 in the same way as shown in FIG. 1 and FIG. 2.

(Fifth Embodiment)

The same signs as those in the first embodiment indicate the items of the same structure, and so long as an item has no particular difference from its equivalent item in the first embodiment, its detailed explanation will be omitted.

Figure 15:
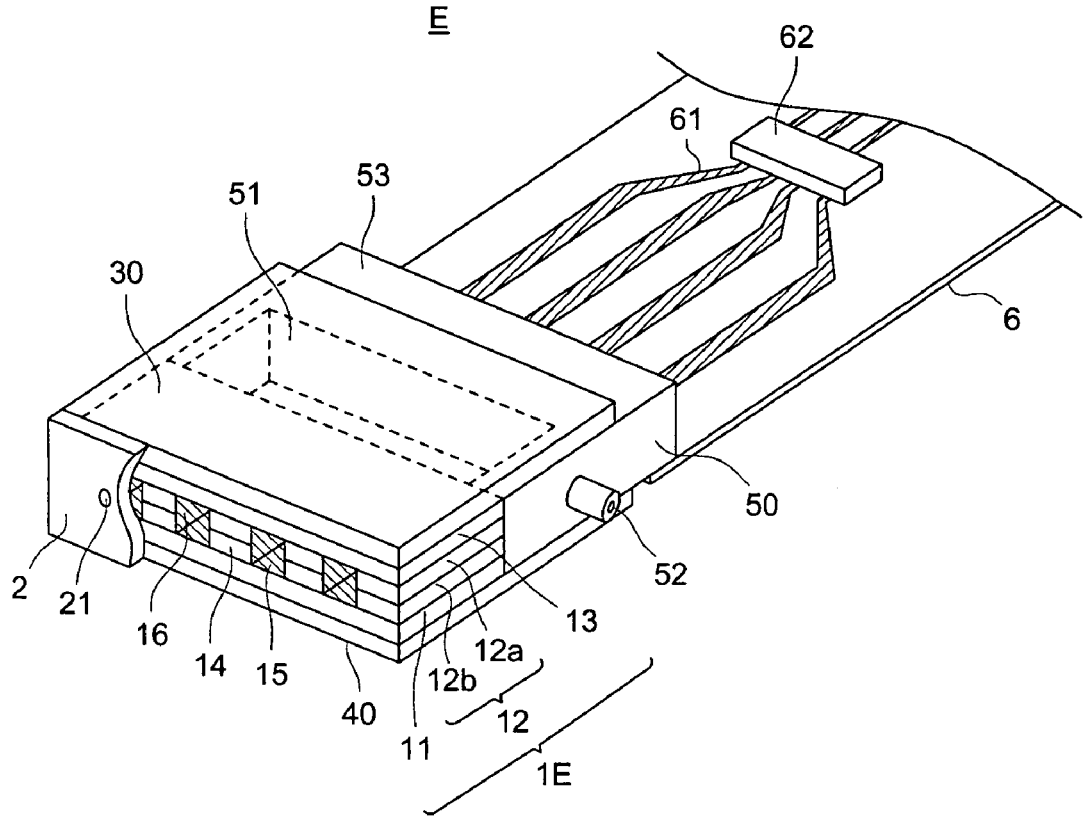
FIG. 15 is a perspective view showing the whole of an ink jet head of the fifth embodiment of this invention.
Figure 16:
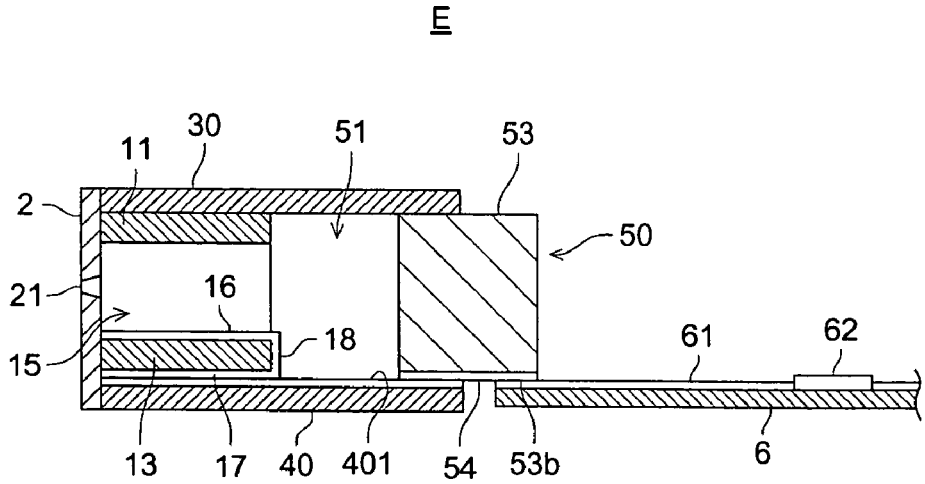
FIG. 16 is a vertical cross-sectional view of the ink jet head shown in FIG. 15.
Figure 17:
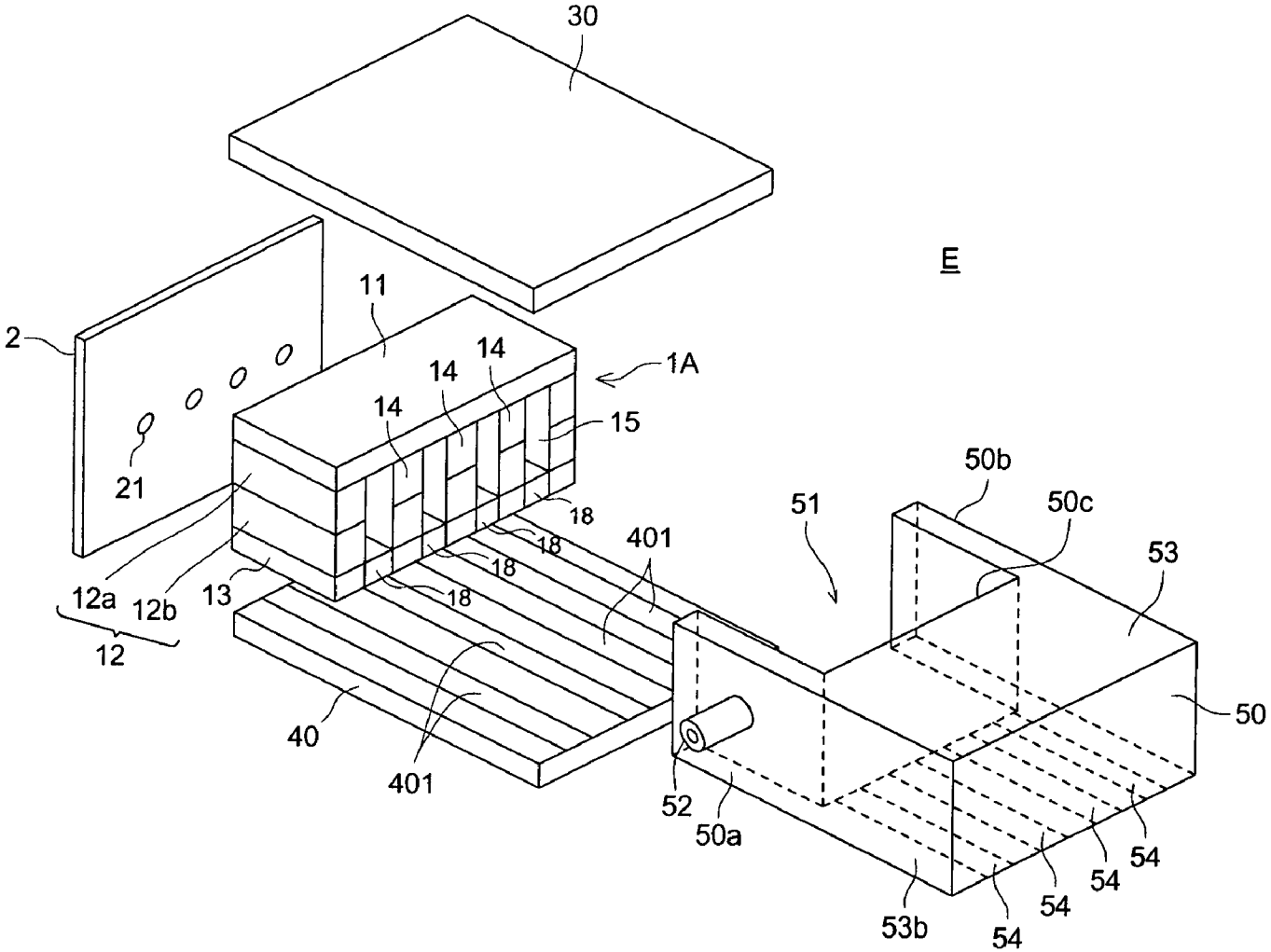
FIG. 17 is an exploded perspective view showing the essential part of an ink jet head of the fifth embodiment.

FIG. 15 is a perspective view showing the whole of an ink jet head of the fifth embodiment of this invention, FIG. 16 is a vertical cross-sectional view of it, and FIG. 17 is an exploded perspective view of its essential part.

In the drawings, the sign E denotes an ink jet head, 1E denotes a head chip, 2 denotes a nozzle plate fixed to the front surface of the head chip 1E, 30 denotes a base plate fixed to the upper surface of the head chip 1E (hereinafter referred to as an top-side base plate), 40 denotes a base plate fixed the lower surface of the head chip 1E (hereinafter referred to as a bottom-side base plate), and 50 denotes an ink supply room forming member (an enclosure wall member).

As shown in FIG. 16, in the head chip 1E, first lead wires 17 to be electrically connected with drive electrodes 16 formed on their respective drive walls 14 are formed on the surface to be fixed to the top-side base plate 30 or the bottom-side base plate 40. As regards a concrete method for making an electrical connection from the drive electrodes 16 to these first lead wires 17, it is not limited to any particular one; for example, as described in the aforementioned patent literature 3, it is appropriate that through holes are formed on the top-side base plate or the bottom-side base plate, and lead wires are made to come out through these through holes; however, it is desirable to use a method shown in the drawing for the purpose of making unnecessary the above-mentioned troublesome works for forming such through holes and making it possible to make the lead wires come out more simply.

That is, on the lower surface of the head chip 1E, the outer surface of the lower base plate 13, the first lead wires 17 of the same number as the number of channel portions 15 are formed parallel to one another with the same pitch as the channel portions 15, and extend from the front edge to the rear edge of the head chip 1E. The surface for the formation of these first lead wires 17 is not limited to the lower surface of the head chip 1E, but it may be the upper surface of the head chip 1E, that is, the outer surface of the upper base plate 11, or the first lead wires may be formed on both the upper and lower surfaces of the head chip 1E.

As regards these first lead wires 17, although the detail will be described later, because they are electrically connected with second lead wires for applying a voltage from a drive circuit to each of the drive electrodes 16, if they are formed on both the upper and lower surfaces of the head chip 1E, this connection with the second lead wires can be made from any of the upper and lower surfaces of the head chip 1E. That is, it is possible to fix a base plate having the second lead wires formed on it on any one of the upper and lower surfaces of the head chip 1E, it is unnecessary to select the direction of the head chip 1E, which is advantageous in terms of the production of the ink jet heads.

Further, on the rear surface of the head chip 1E, to state it particularly, on the rear surface of the lower base plate 13, there are formed connection wires 18 whose one end are to be electrically connected with their respective drive electrodes 16 formed on the drive walls 14 in the channel portions 15, and the other end of them are electrically connected with the first lead wires corresponding to them respectively. Accordingly, it is practiced to made lead wires come out which are electrically connected to the respective drive electrodes 16 through these connection wires 18 over a range extending from the rear surface of the head chip 1E to the lower surface of the head chip 1E. The surface for the formation of these connection wires is not limited to the rear surface of the head chip 1E, but it may be the front surface of it, or the connection wires may be formed on both the front and rear surfaces of the head chip 1E.

Incidentally, as regards the manufacturing method of this head chip 1E, because it is the same as that of the head chip 1 of the first embodiment, its explanation will be omitted.

The bottom-side base plate 40 to be fixed to the lower surface of the head chip 1E, which is equivalent to one of the head chips having been formed in a way as set forth in the manufacturing method of the head chip 1 of the first embodiment, is made up of a base plate having a width approximately the same as the width of the head chip 1E (the length of the channel portions 15 in the direction of their parallel arrangement) and a length sufficiently longer than the length of the head chip 1E (the length from the front surface to the rear surface of the head chip 1E), and on its surface at the side to be fixed to the head chip 1E, as shown in FIG. 17, the second lead wires 401 are formed parallel to one another with the same pitch as the channel portions 15 of the head chip 1E. These second lead wires 401 can be formed through a process such that the bottom-side base plate is subjected to patterning in the same way as the case of the aforementioned manufacturing of the head chip, and a metal film is deposited by the use of an electroless plating method.

This bottom-side base plate 40 is fixed to the lower surface of the head chip 1E by means of an adhesive, an anisotropic conductive film, or the like, in such a manner that its front edge surface comes to be flush with the front surface of the head chip 1E, with the surface on which the second lead wires 401 are formed made to face the first lead wires 17 in order that the first lead wires can be electrically connected with their respective second lead wires 401.

The top-side base plate 30 is formed to have the same size as the above-mentioned bottom-side base plate 40, and is fixed to the upper surface of the upper base plate 11 of the head chip 1E in such a manner that its front edge surface comes to be flush with the front surface of the head chip 1E. By this, the head chip 1E is brought in a state such that it is held by the top-side base plate 30 and the bottom-side base plate 40 between them both projecting rearward from said head chip 1E.

The nozzle plate 2 is fixed to the front side of the head chip 1E having the top-side base plate 30 and the bottom-side base plate 40 fixed thereto. In the nozzle plate 2, nozzle holes 21 corresponding to their respective channel portions 15 are opened.

The ink supply room forming member 50 is provided at the rear side of the head chip 1E between the top-side base plate 30 and the bottom-side base plate 40. This ink supply room forming member 50 is made of a high-function resin called an engineering plastic such as polyimide, polycarbonate, etc., and is formed of an enclosure wall portion (side walls 50*a* and 50*b*, and rear wall 50*c*) presenting a U-shape in the plan view provided in such a manner as to enclose the rear surface of said head chip 1E. By this, at the rear side of the head chip 1E, it is formed a space enclosed by the top-side base plate and the bottom-side base plate for its upper and lower side, and by the enclosure wall portions 50*a*, 50*b*, and 50*c* making up this ink supply room forming member 50 for its flank sides, and an ink supply room 51 for supplying ink to each of the channels 15 is formed of this space.

The sign 52 denotes an inlet for letting ink flow into the ink supply room 51, and by this, the ink supply room 51 functions as an ink manifold. Although not shown in the drawing, this ink supply room 51 has a filter for preventing the flowing-in of dusts inside.

Owing to the ink supply room forming member 50 shown in this embodiment of the invention being formed of the enclosure wall portions 50*a*, 50*b*, and 50*c* provided in such a manner as to enclose the rear side of the head chip 1E between the top-side base plate 30 and the bottom-side base plate 40 as explained above, there is an advantage that only an extremely small part of the area located at both the side edge portions of the head chip 1E is required for the area for the fixing of this ink supply room forming member to the head chip 1E.

That is, up to this time, generally, an ink supply room forming member for making up an ink supply room (an ink manifold) has a structure such that a box-shaped member having an opening at its one side is fixed to the head chip over the whole area of the top-side base plate and the bottom side base plate in such a manner that said opening surrounds the whole area including all the channel portions; therefore, it is necessary to secure an bonding area for the fixing over the whole area of the upper base plate and the lower base plate of the head chip. Accordingly, for the purpose of securing this bonding area, it is required to make the upper base plate and the lower base plate larger excessively, which makes it necessary to form the head chip to have a uselessly larger size. On top of it, because it is necessary to coat an adhesive on an extremely minute spaces such as the rear surface of the upper base plate and the lower base plate, the coating operation is troublesome, and on top of it, there is even the possibility that the adhesive is pressed out to the channel portions.

However, as shown in this embodiment, by the ink supply room 51 being formed of the enclosure wall portions 50*a*, 50*b*, and 50*c*, it is not required to coat an adhesive over the whole area of the upper base plate and the lower base plate; therefore, neither the formation of the head chip 1E to have a uselessly larger size for the formation of the ink supply room 51, nor the coating operation of an adhesive on a minute space is necessary, which makes it possible to achieve the improvement of productivity; this is a desirable mode of the embodiment of this invention.

The ink supply room forming member 50 shown in this embodiment has its rear wall 50*c* projecting rearward from the top-side base plate 30 and the bottom-side base plate 40, to form a projection portion 53. Accordingly, in the rearward part of the ink supply room forming member 50, the surfaces, each of which is one and the same as the surface which is fixed to each of the above-mentioned top-side base plate and the bottom-side base plate, project out of said top-side base plate 30 and bottom-side base plate 40 and are partly exposed upward and downward respectively.

On this ink supply room forming member 50, there are formed third lead wires 54 whose one end are electrically connected to the above-mentioned second lead wires 401, while whose the other end are made to come out to the outer surface of said ink supply room forming member 50. In this example, because the second lead wires are formed on the bottom-side base plate 40, as shown in FIG. 16 and FIG. 17, these third lead wires 54 are formed parallel to one another with the same number and the same pitch as the second lead wires 401 on the lower surface of the ink supply room forming member 50. Further, the other end of the third lead wires 54 extends up to the surface 53*b* exposed downward in the projection portion 53 in the rearward part of the ink supply room forming member 50. These third lead wires 54 can be formed through a process such that, in the same way as the case of the above-mentioned manufacturing of the head chip, patterning is applied to the ink supply room forming member 50, and a metal film is deposited by the use of an electroless plating method.

A circuit board 6 is bonded to this ink jet head E by means of an anisotropic conductive film, in such a manner that lead wires 61 formed on its surface are electrically connected with their respective third lead wires 54 formed on the ink supply room forming member 50, and extends rearward from the ink jet head E. By the electrical connection with this circuit board 6, the ink jet head E is electrically connected to a drive circuit, which makes it possible to apply a voltage to each of the drive electrodes 16.

It is desirable that this circuit board 6 is a flexible board (FPC). Further, it is desirable if this circuit board 6 is equipped with a drive IC 62 as shown in the drawing, because this makes it possible to achieve the reduction of the number of the connection terminals.

In this way, in the ink jet head E, because the lead wires for applying a voltage to each of the drive electrodes 16 are made to come out to the outer surface of the ink supply room forming member 50, by the mere bonding of the circuit board 6 with the third lead wires 54 at the outer surface of the ink supply room forming member 50, it is possible to carry out extremely simply the electrical connection of the drive electrodes 16 in the channel portions 15 to the circuit board 6.

On top of it, because the third lead wires 54 are made to come out to the outer surface of the ink supply room forming member 50 located at the most rearward position of the ink jet head E by the utilization of it, there is an advantage that the direction of the connection of the circuit board 6 can be selected in accordance with the mode of how to make these third lead wires 54 come out.

Figure 18:
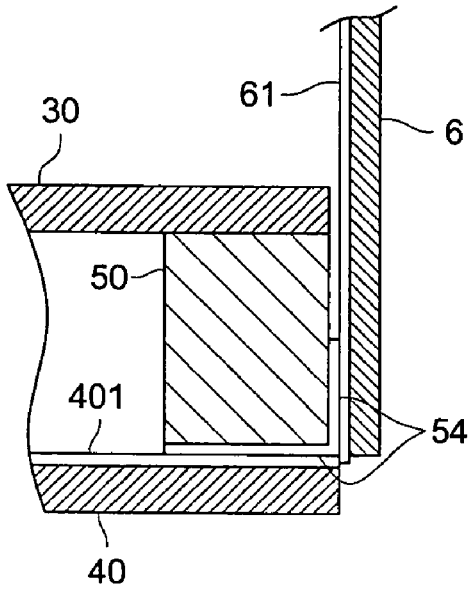
FIG. 18 is a vertical cross-sectional view showing the essential part of an ink jet head of another mode of the fifth embodiment.

For example, in FIG. 18, the third lead wires 54 are formed in such a manner as to be made to come out from the lower surface of the ink supply room forming member 50 up to on the rear surface of it. By the circuit board 6 being bonded to the rear surface of this ink supply room forming member 50 in such a manner that its lead wires are electrically connected with the respective third lead wires 54, the direction of the connection of the circuit board 6 can be made upward (or downward). In addition, in this case, it is appropriate that the rear surface of the ink supply room forming member 50 is at least flush with the rear edge surface of the top-side base plate 30 and the bottom-side base plate 40, and it is not always necessary to form the projecting portion 53.

Incidentally, it is desirable that at least one of the members except for the drive walls 14 in the head chip A (namely, both the base plates of the upper base plate 11 and the lower base plate 13), the top-side base plate 30, and the bottom-side base plate 40 is made of any one material selected from a ceramic material containing aluminum nitride as a constituent, a piezoelectric material, and a liquid crystal polymer. By this, it is given an effect that an ink jet head which has an excellent heat dissipation property, and is stable against temperature change can be obtained.

Further, it is more desirable that the thermal expansion coefficient of at least one of the members except for the drive walls 14 in the head chip 1E (namely, both the base plates of the upper base plate 11 and the lower base plate 13), the top-side base plate 30, and the bottom-side base plate 40 is the thermal expansion coefficient of the piezoelectric element 12 making up the drive walls 14 ±2 ppm/° C. By the thermal expansion coefficient being made to fall within this range, separation etc. between the base plates due to the difference in the thermal expansion coefficient are not produced.

Further, because the connection wires 18 (lead wires provided on the rear surface of the head chip) and a part of the second lead wires 401 face the ink supply room 51, these become in direct contact with the ink in the same way as the drive electrodes 16 in the channel portions 15. Accordingly, in the case where an aqueous ink is used for the ink, it is desirable to form an electrode protection film on the surface of the drive electrodes 16 in the channel portions 15, the connection wires 18, and the second lead wires 401. For the electrode protection film, an organic insulating film is desirable because it has flexibility, is hard to peel off, is easy to comply with the shearing deformation of the drive walls 14, and improves much more the durability of the drive electrodes 16. Further, for the organic insulating film, a parylene film is desirable.

(Sixth Embodiment)

Figure 19:
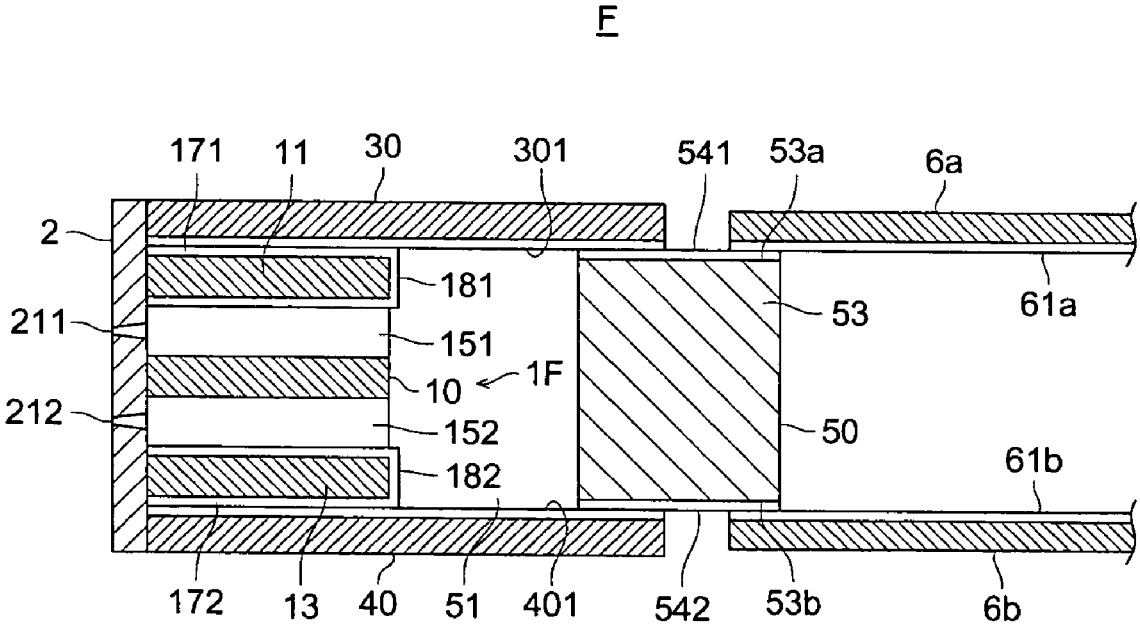
FIG. 19 is a vertical cross-sectional view showing an ink jet head of the sixth embodiment of this invention.

FIG. 19 is a vertical cross-sectional view showing an ink jet head F of the sixth embodiment of this invention. The same signs as those in the fifth embodiment indicate the items of the same structure, and so long as an item has no particular difference from its equivalent item in the fifth embodiment, its detailed explanation will be omitted.

A head chip 1F in this ink jet head F has drive walls and channel portions formed in two stages in the vertical direction. In this embodiment, drive walls and channel portions are formed in two stages in the vertical direction to form one head chip 1F in this way.

Figure 28:
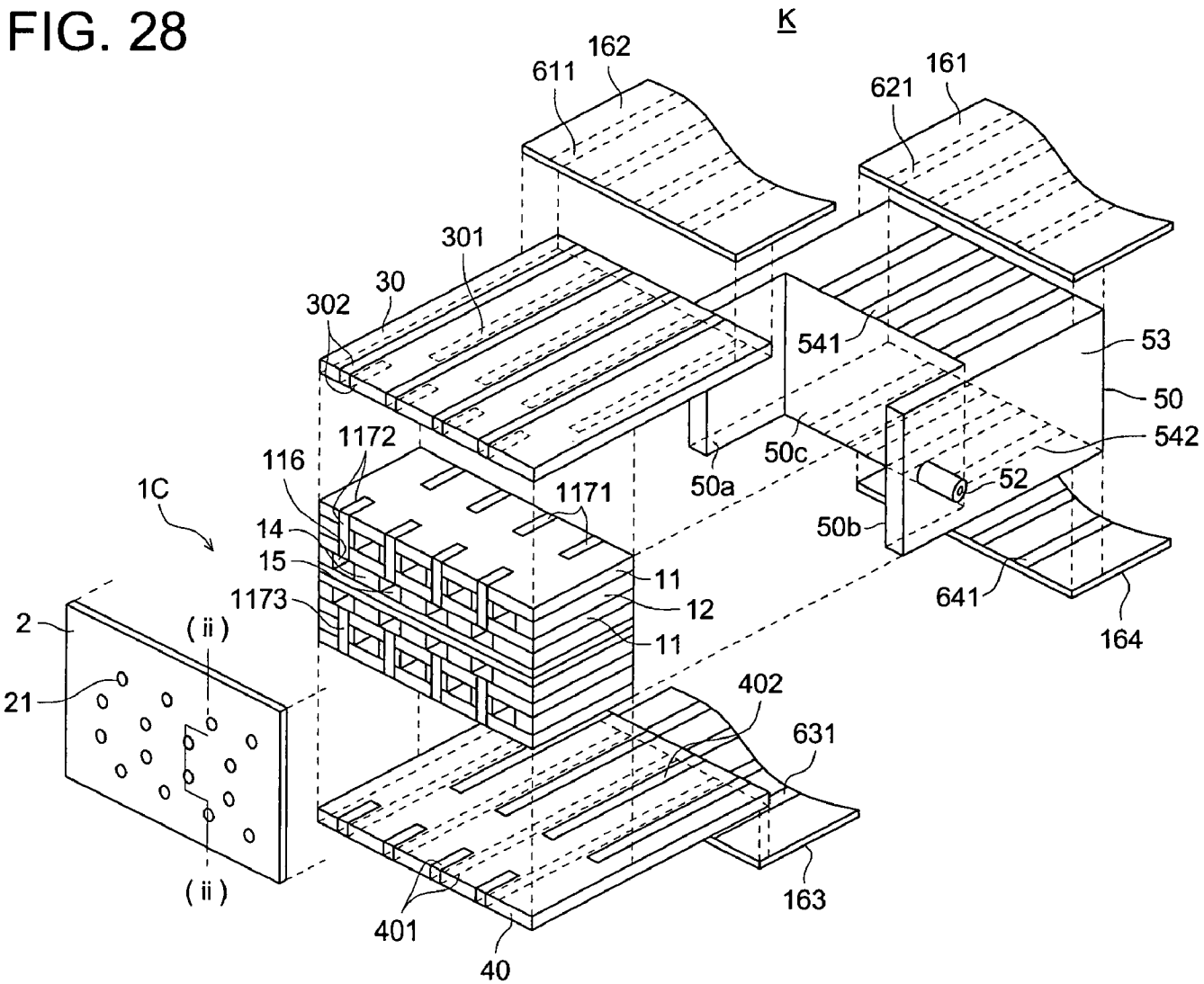
FIG. 28 is an exploded perspective view of an ink jet head of the tenth embodiment of this invention.

FIG. 28 is a perspective view of the head chip F as viewed from the rear side. The head chip 1F comprises an upper stage composed of drive walls 141 made up of a piezoelectric element 121 and channel portions 151 at the upper side arranged alternately and a lower stage composed of drive walls 142 made up of a piezoelectric element 122 and channel portions 152 at the lower side arranged alternately. The piezoelectric elements 121 and 122 are composed of a pair of piezoelectric material base plates 121*a* and 121*b*, and a pair of piezoelectric base plates 122*a* and 122*b* respectively, and in each of both the pairs, the two piezoelectric material base plates have the polarization directions reverse to each other.

Between the upper stage composed of the drive walls 141 and the channel portions 151 and the lower stage composed of the drive walls 142 and the channel portions 152, an intermediate base plate 10 similar to the upper base plate 11 or the lower base plate 13 is provided. This head chip 1F can be also obtained by the use of two pieces of the head chip 1E of the above-mentioned fifth embodiment being stacked in the vertical direction, but by the common use of a single piece of the intermediate base plate 10 between the upper stage and the lower stage, the reduction of the number of the parts can be achieved.

In the head chip 1F, first lead wires 171 and 172 corresponding to the drive electrodes 161 and 162 in the channel portions 151 and 152 respectively are formed on the upper surface and the lower surface of the head chip 1F respectively. That is, the first lead wires 171 to be electrically connected to the channel portions 151 located at the upper side in the drawing through the connection wires 181 are formed on the outer surface of the upper base plate 11 of the head chip 1F, and the first lead wires 172 to be electrically connected to the channel portions 152 located at the lower side in the drawing through the connection wires 182 are formed on the outer surface of the lower base plate 13 of the head chip 1F.

Figure 6:
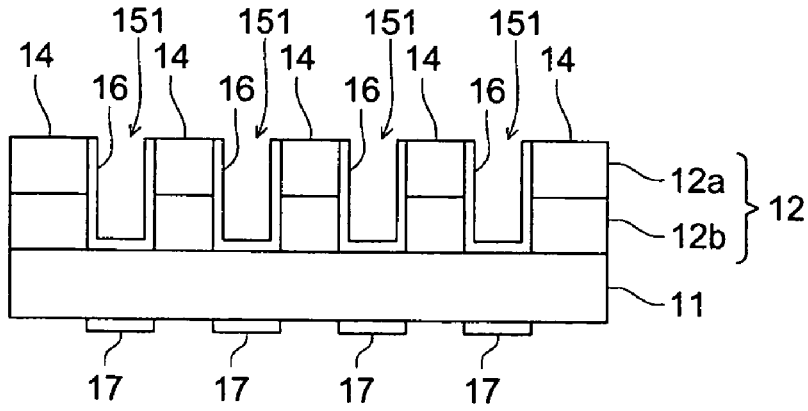
FIG. 6 is a drawing showing one process of a manufacturing method of an ink jet head.
Figure 20:
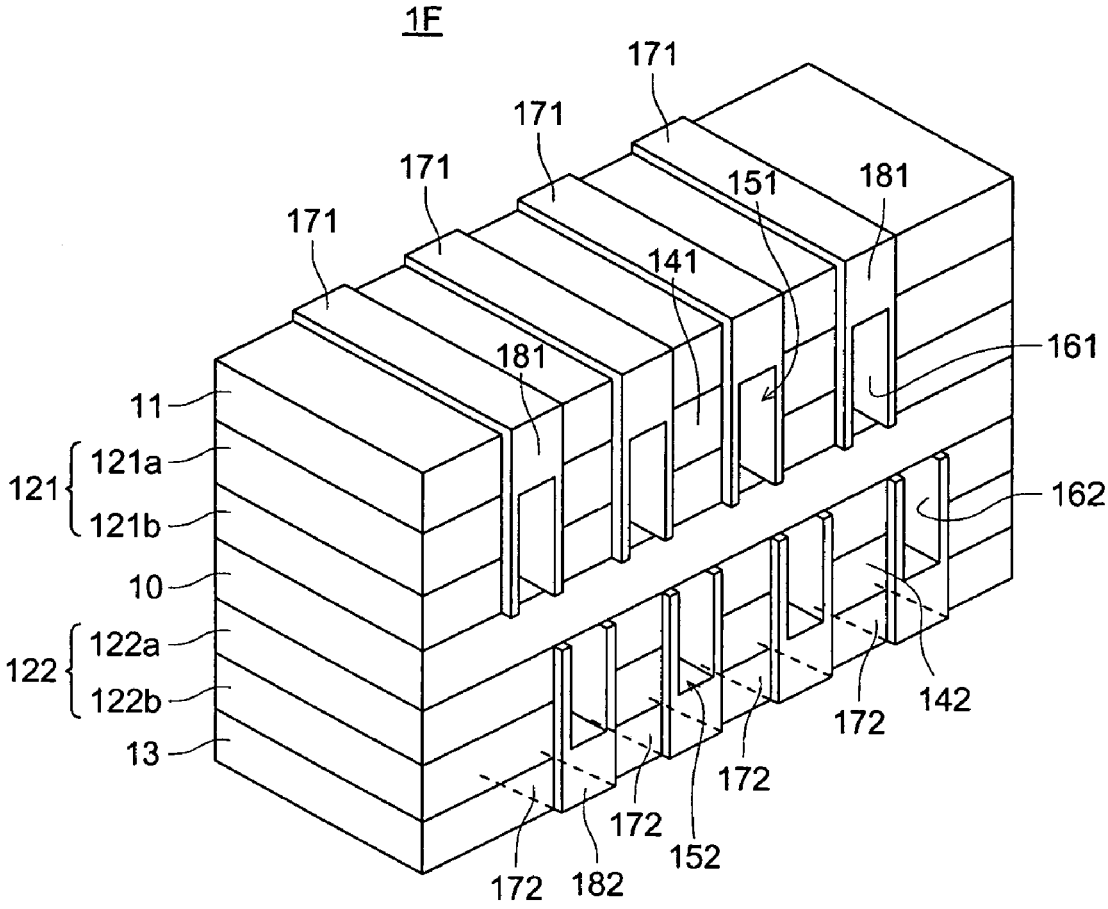
FIG. 20 is a perspective view showing the head chip of an ink jet head of the sixth embodiment.

Besides, this head chip 1F can be manufactured through a process such that, for example, the side of the head base plate shown in FIG. 6 at the drive walls 14 is fixed onto the upper base plate 11 of the head base plate a shown in FIG. 7 (In this case, the upper base plate 11 corresponds to the intermediate base plate of FIG. 20, and the lower base plate shown in FIG. 7 corresponds to the upper base plate 11 shown in FIG. 20.), after that, patterning is carried out by means of a dry film having openings 201 for the formation of the connection wires in the same way as FIG. 1, and then, an aluminum film is coated by evaporation coating to form the connection wires 181 and 182.

A top-side base plate 30 and a bottom-side base plate 40 having second lead wires 301 and 401 respectively on their surfaces are fixed to the upper surface and the lower surface of the head chip 1F respectively with their second lead wires 301 and 401 electrically connected to the respective first lead wires 171 and 172.

Further, by an ink supply room forming member 50 similar to that of the fifth embodiment being provided in such a manner as to enclose the rear side of the head chip 1F commonly between the top-side base plate 30 and the bottom-side base plate 40, an ink supply room 51 for supplying ink to each of the channel portions 151 and 152 of the head chip 1F composed of upper and lower two stages is formed.

This ink supply room forming member 50 projects rearward but of the top-side base plate 30 and the bottom-side base plate 40 by a large margin, to form a projection portion 53. Accordingly, as regards the ink supply room forming member 50, its surfaces the same as the surfaces fixed to the top-side base plate 30 and the bottom-side base plate 40 respectively project from the rear edge of said top-side base plate 30 and bottom-side base plate 40, and are partly exposed upward and downward respectively.

Further, on the upper surface and the lower surface of this ink supply room forming member 50, there are formed third lead wires 541 and 542 respectively whose one end are electrically connected with the second lead wires 301 and 401 of the above-mentioned top-side base plate 30 and bottom-side base plate 40 respectively, and the other end of them are made to come out from the rear edge of the above-mentioned top-side base plate 30 and the bottom-side base plate 40 up to the upper surface 53*a* and the lower surface 53*b* of the above-mentioned projection portion 53 respectively.

Further, the nozzle plate 2 has a size covering the area of the front surface of the head chip 1F made up of the upper and lower two stages and the front edge surface of the top-side base plate 30 and the bottom-side base plate 40, and has nozzle holes 211 and 212 formed in upper and lower two rows in correspondence with the respective channel portions 151 and 152 of the head chip 1F.

For this ink jet head F, at the projection portion 53 of the ink supply room forming member 50, a top-side circuit board 6*a* is connected to the surface 53*a* exposed upward, in such a manner that lead wires 61*a* formed on its surface are electrically connected to the above-mentioned third lead wires 541 by means of an anisotropic conductive film, and a bottom-side circuit board 6*b* is connected to the surface 53*b* exposed downward, in such a manner that lead wires 61*b* formed on its surface are electrically connected to the above-mentioned third lead wires 542 by means of an anisotropic conductive film, both extending rearward from the ink jet head F. By being electrically connected to the circuit boards 6*a* and 6*b*, the ink jet head F is electrically connected to a drive circuit, to become capable of applying a voltage to their respective drive electrodes 161 and 162.

In this ink jet head F of the sixth embodiment of the invention, the drive walls 141 and 142 and the channel portions 151 and 152 are formed in two stages in the vertical direction, which makes the head be of a multi-stage nozzle type, and in the same way as the fifth embodiment, the third lead wires 541 and 541 are made to come out to its outer surface by the utilization of the ink supply room forming member 50 located at the most rearward position; therefore, the electrical connection to a drive circuit can be easily made by the utilization of this ink supply room forming member 50. That is, there is an advantage that the electrical connection of the drive electrodes 161 and 162 in the channel portions 151 and,152 with the lead wires from a drive circuit can be carried out simply, and high-density ink jet heads of high productivity can be provided.

Figure 21:
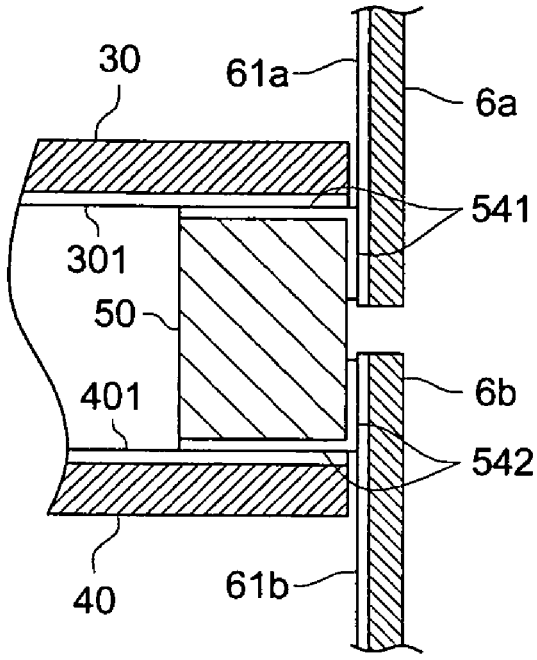
FIG. 21(*a*) is a vertical cross-sectional view showing the essential part of an ink jet head of another mode of the sixth embodiment, and FIG. 21(*b*) is a drawing showing the rear side of the above-mentioned ink jet head.
Figure 21:
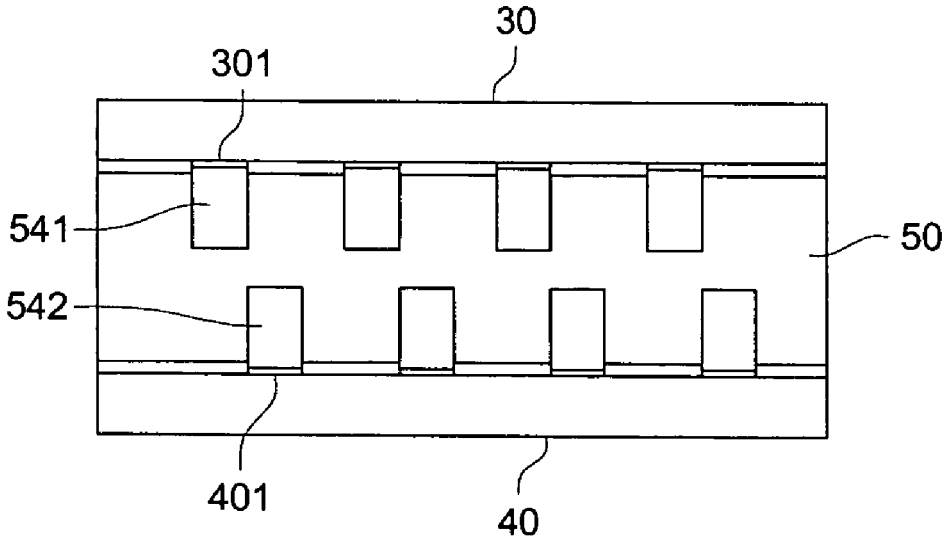

In this case also, the direction of connection of the circuit boards 6*a* and 6*b* can be selected in accordance with the method of how to make the third lead wires 541 and 542 come out to the outer surface of the ink supply room forming member 50. For example, as shown in FIG. 21(*a*), by the third lead wires being made to come out from the upper surface and the lower surface respectively up to on the rear surface, the connection direction of the circuit boar 6*a* for the upper channel portions 151 can be made upward, and the connection direction of the circuit board 6*b* for the lower channel portions 152 can be made downward. In this case, as shown in FIG. 21(*b*), on the rear surface of the ink supply room forming member 5, the third lead wires 541 made to come out from the upper channel portions 151 and the third lead wires 542 made to come out from the lower channel portions 152 are formed in such a manner that the end portion of both the third lead wires 541 and 542 are not in contact with each other.

Further, as shown in FIG. 22(*a*), it is possible to substitute the circuit board for the upper channel portions 151 and the circuit board for the lower channel portions 152 by a single common circuit board 6. By this, because the electrical connection of the drive electrodes of the upper and lower channel portions 151 and 152 with the drive circuit is enabled by a connection operation of the single circuit board 6, the efficiency of operation becomes excellent. As shown in FIG. 22(*b*), in this single circuit board 6, lead wires 611 from the drive circuit for applying a voltage to the upper channel portions 151 and lead wires 612 from the drive circuit for applying a voltage to the lower channel portions 152 are formed in such a manner that the end portions of both the lead wires 611 and 612 are not in contact with each other.

Further, in the mode of the embodiment shown in FIG. 21(*a*) and FIG. 21(*b*), or in FIG. 22(*a*) and FIG. 22(*b*), because the direction of bonding operation of the circuit boards 6*a* and 6*b*, or the circuit board 6 is only one direction from the rear side, the efficiency of operation for the bonding of the circuit boards 6*a* and 6*b*, or the circuit board 6 is excellent compared to the mode shown in FIG. 19 in which the direction of bonding operation becomes two ways from the upper side and from the lower side.

Figure 23:
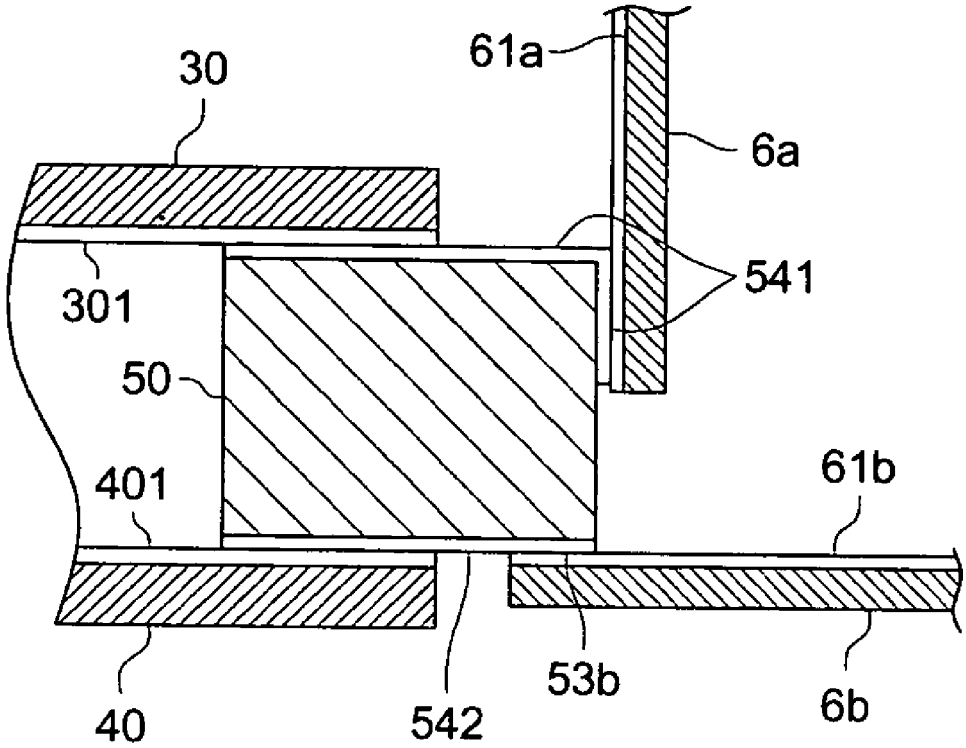
FIG. 23 is a vertical cross-sectional view of an ink jet head of a still further another mode of the sixth embodiment.

Further, as shown in FIG. 23, also it is possible to make the connection direction of the upper-side circuit board 6*a* and the lower-side circuit board 6*b* different from each other in the following way. For example, by the third lead wires of the upper side 541 being made to come out up to on the rear surface of the ink supply room forming member 50, the connection direction of the circuit board of the upper side 6*a* is made upward, and by the lead wires of the lower-side circuit board 6*b* being electrically connected with the third lead wires 542 formed on the lower surface 53*b* of the projection portion 53 of the ink supply room forming member 50, the connection direction of the lower-side circuit board 6*b* is made rearward.

(Seventh Embodiment)

Figure 24:
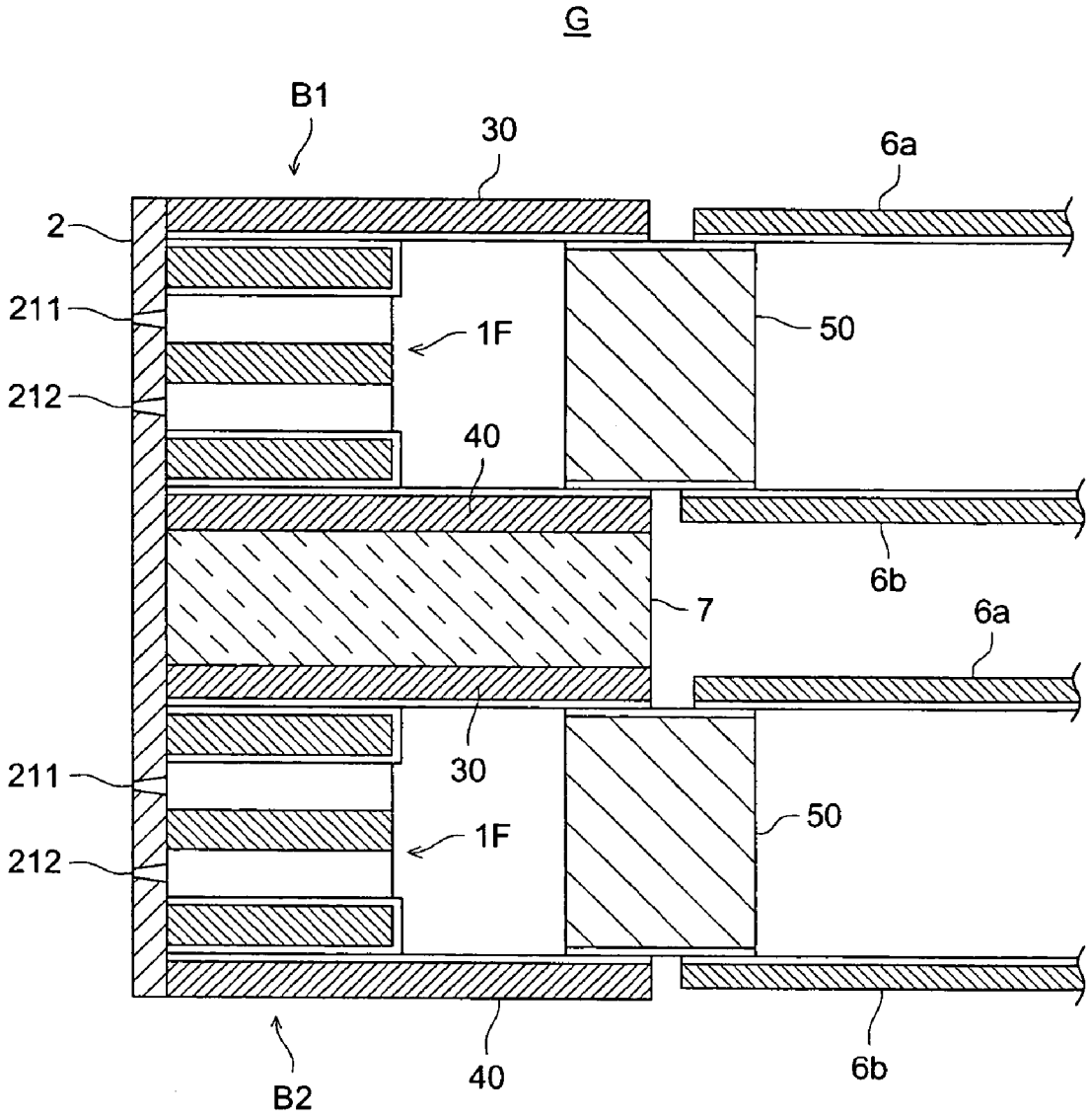
FIG. 24 is a vertical cross-sectional view of an ink jet head of the seventh embodiment.

FIG. 24 shows an ink jet head G of the seventh embodiment of this invention. The same signs as those in the fifth and sixth embodiments indicate the items of the same structure, and so long as an item has no particular difference from its equivalent item in the fifth or sixth embodiment, its detailed explanation will be omitted.

This ink jet head G has a structure such that a plurality of ink jet heads F of the sixth embodiment are used to aim at a further multi-row nozzle structure.

That is, with the ink jet head F shown in FIG. 19 in a state that the head chip 1F having the drive walls and the channel portions formed in upper and lower two stages is held by the top-side base plate 30 and the bottom-side base plate 40 in between taken for one unit, by the use of two of these units (F1, F2) stacked in the vertical direction, an ink jet head having drive walls and channel portions in four stages as the total in the vertical direction is formed.

It is desirable to take a countermeasure for the heat generation during driving by a heat dissipation member 7 such as a heat sink, as shown in the drawing, being provided between the ink jet head units F1 and F2 stacked in the vertical direction.

It may be appropriate to form a nozzle plate for each of the ink jet head units F1 and F2, but it is desirable, as shown in the drawing, to use a single nozzle plate 2 for the whole, because this makes it possible to simplify the bonding operation of the nozzle plate 2.

Further, this ink jet head G is not limited to the one having ink jet head units F1 and F2 stacked in two stages, and by the increasing of the number of stacked layers to three stages, four stages, or more in the vertical direction, it is possible to make the head have a further multi-row nozzle structure.

By this ink jet head G, it is possible to carry out simply the electrical connection of the drive electrodes 161 and 162 in the respective channel portions 151 and 152 with the lead wires from the drive circuit; therefore, there is an advantage that a high-density ink jet head of high productivity can be provided.

(Eigth Embodiment)

Figure 25:
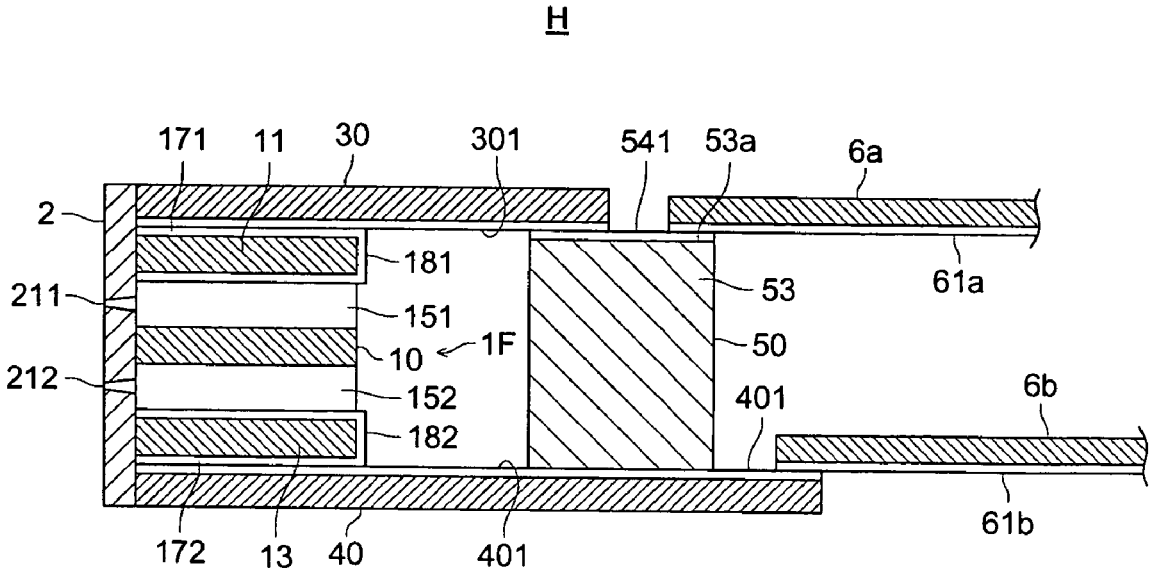
FIG. 25 is a vertical cross-sectional view of an ink jet head of the eighth embodiment.

FIG. 25 shows an ink jet head H of the eighth embodiment of this invention. The same signs as those in the fifth and sixth embodiments indicate the items of the same structure, and so long as an item has no particular difference from its equivalent item in the fifth or sixth embodiment, its detailed explanation will be omitted.

This ink jet head H, in the same way as the ink jet head F of the sixth embodiment, has channel portions and drive electrodes stacked in two stages in the vertical direction, but it is different from the ink jet head F in the way of connection with the circuit board 6.

That is, in this ink jet head H, the rearward part of the ink supply room forming member 50 projects out of the top-side base plate 30 to form a projection portion 53, and its upper surface 53*a* is exposed upward; however, the bottom-side base plate 40 extends rearward out of the ink supply room forming member 50 by a large margin, to form an extension portion 42.

On the upper surface of the ink supply room forming member 50, there are formed third lead wires 541 extending from the front edge to the rear edge to be electrically connected with second lead wires 301 formed on the top-side base plate 30, and are electrically connected to the channel portions 151 of the upper side of the head chip 1F through the second lead wires 301, first lead wires 171, and connection wires 181; however, on the lower surface of this ink supply room forming member 50, there is formed no third lead wires, and second lead wires 401 provided on the surface of the bottom-side base plate 40 extends through the fixing area to the ink supply room forming member 50 up to the upper surface of the extension portion 42.

Accordingly, a circuit board 6*a* for making the electrical connection of a drive circuit to the channel portions 151 of the upper side in the head chip 1F is bonded in such a way that its lead wires 61*a* are electrically connected with the third lead wires 541 exposed on the upper surface of the ink supply room forming member 50, while a circuit board 6*b* for making the electrical connection of a drive circuit to the channel portions 152 of the lower side is bonded in such a way that its lead wires 62*b* are electrically connected with the second lead wires 401 exposed on the upper surface of the extension portion 42 of the bottom-side base plate 40. These bonding operations may be carried out in such a way that after the circuit board 6*b* of the lower side as shown in the drawing is bonded to the extension portion 42 of the bottom-side base plate 40, the circuit board 6*a* of the upper side as shown in the drawing is bonded to the upper surface of the ink supply room forming member 50.

By this ink jet head H, it is possible to carry out simply the electrical connection of the drive electrodes 161 and 162 in the respective channel portions 151 and 152 with the lead wires from the drive circuit; therefore, there is an advantage that a high-density ink jet head of high productivity can be provided.

On top of it, because it is possible to make the direction of the bonding operation from only one direction (from the upper side only as shown in the drawing of FIG. 25), the efficiency of the bonding operation of the circuit boards 6*a* and 6*b* is excellent compared to the mode in which the bonding operation is done in two ways from the upper and lower directions opposite to each other.

Further, as regards the third lead wires 541 for making the electrical connection with the circuit board 6*a*, only it is required to form them only on the upper surface of the ink supply room forming member 50; further, as regards the second lead wires 401 for making the electrical connection with the circuit board 6*b*, only it is necessary to extend them as they are on the surface of the bottom-side base plate 40, and it is unnecessary to make the third lead wires come out up to on the rear surface of the ink supply room forming member 50 as is done in the modes shown in FIG. 21(*a*) and FIG. 22(*a*); therefore, wiring formation can be also simplified.

In addition, it is a matter of course that it is appropriate to make the ink jet head of a mode of the embodiment which is reversed to the one shown in FIG. 25 upside down, by the formation of an extension portion of the top-side base plate 30 for the bonding of the circuit board 5*a* and the formation of the third lead wires on the lower surface of the ink supply room forming member 50.

(Ninth Embodiment)

Figure 26:
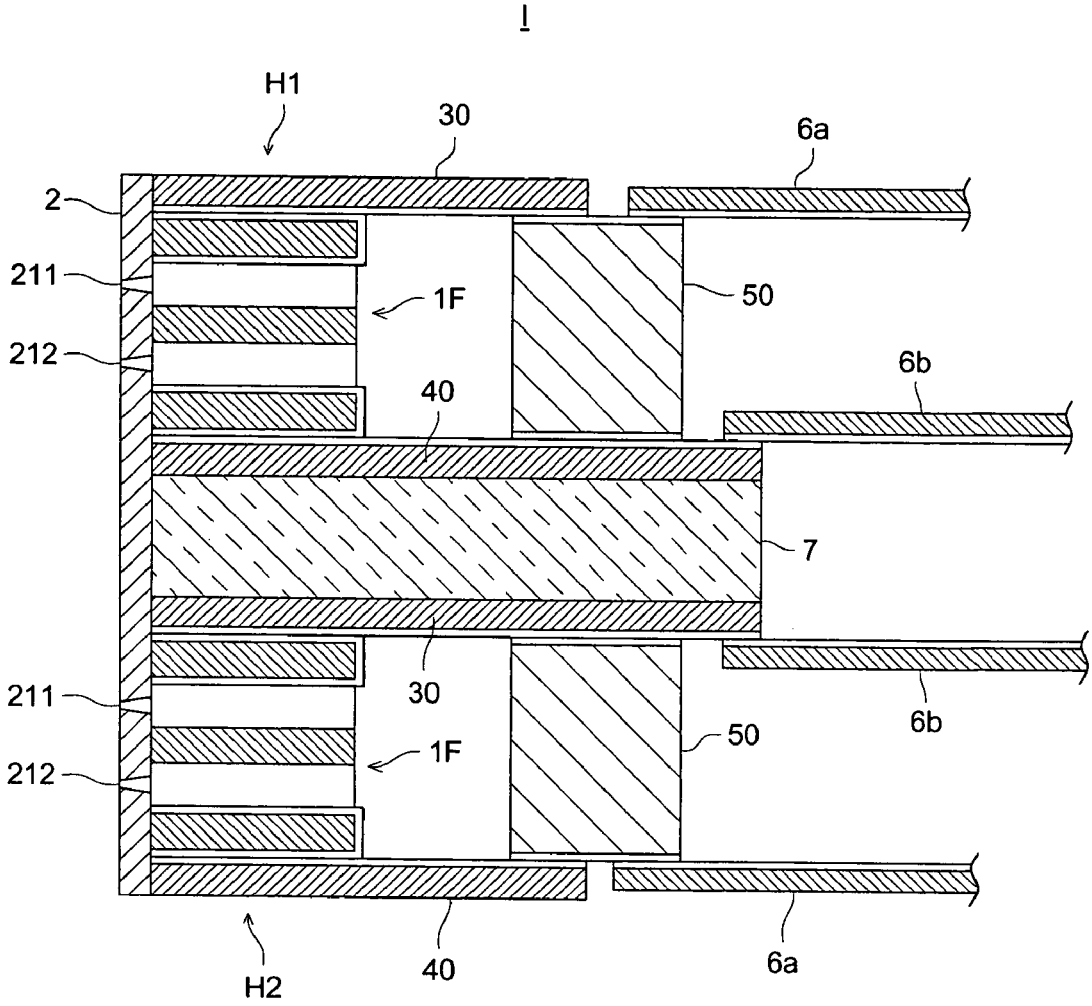
FIG. 26 is a vertical cross-sectional view of an ink jet head of the ninth embodiment.

FIG. 26 shows an ink jet head I of the ninth embodiment of this invention. The same signs as those in the fifth and sixth embodiments indicate the items of the same structure, and so long as an item has no particular difference from its equivalent item in the fifth or sixth embodiment, its detailed explanation will be omitted.

This ink jet head I has a structure such that a plurality of ink jet heads H of the eighth embodiment are used to aim at a further multi-row nozzle structure.

That is, with the ink jet head H shown in FIG. 25 in a state such that the head chip 1F having the drive walls 141 and 142 and the channel portions 151 and 152 formed in upper and lower two stages is held by the top-side base plate 30 and the bottom-side base plate 40 in between taken for one unit, by the use of two of these units (H1, H2) stacked in the vertical direction, the ink jet head I having drive walls 141 and 142 and the channel portions 151 and 152 in four stages as the total in the vertical direction is formed.

It is desirable to take a countermeasure for the heat generation during driving by a heat dissipation member 7 such as a heat sink, as shown in the drawing, being provided between the ink jet head units H1 and H2 stacked in the vertical direction.

It may be appropriate to form a nozzle plate 2 for each of the ink jet head units H1 and H2, but it is desirable, as shown in the drawing, to use a single nozzle plate 2 for the whole, because this makes it possible to simplify the bonding operation of the nozzle plate 2.

Further, this ink jet head I is not limited to the one having ink jet head units H1 and H2 stacked in two stages, and by the increasing of the number of stacked layers to three stages, four stages, or more in the vertical direction, also it is possible to make the head have a further multi-row nozzle structure.

By this ink jet head I, it is possible to carry out simply the electrical connection of the drive electrodes 161 and 162 in the respective channel portions 151 and 152 with the lead wires from the drive circuit; therefore, there is an advantage that a high-density ink jet head of high productivity can be provided.

Figure 27:
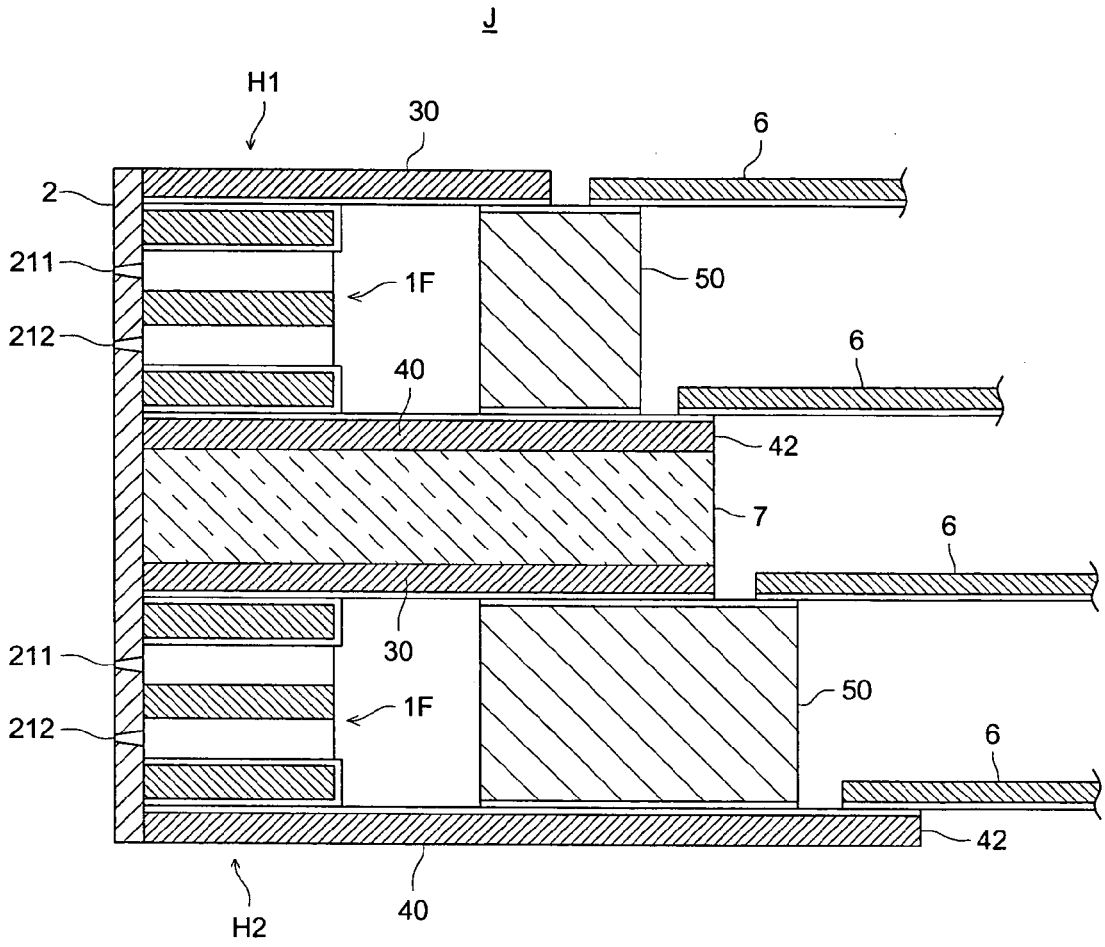
FIG. 27 is a vertical cross-sectional view of an ink jet head of another mode of the ninth embodiment.

In addition, in this example, the upper-side ink jet head unit H1 and the lower-side ink jet head unit H2 are stacked in such a way that the bottom-side base plates 40 of both the units face each other with the heat dissipation member 7 put in between, but the structure is not limited to this. For example, also it is appropriate, just as an ink jet head J shown in FIG. 27, to stack the units in such a manner that the bottom-side base plate 40 of the upper-side ink jet head unit H1 and the top-side base plate 30 of the lower-side ink jet head unit H2 face each other with the heat dissipation member 7 put in between.

In this case, it is desirable to make the ink jet head I have a structure such that the top-side base plate 30 of the lower-side ink jet head unit H2 is formed to have approximately the same length as the length of the bottom-side base plate 40 of the upper-side ink jet head unit H1 having the extension portion 42 formed, and the ink supply room forming member of the lower-side ink jet head unit H2 is formed in such a way that its rear part extends rearward from the rear edge of the top-side base plate 30 by a large margin, while the bottom-side base plate 40 of the lower-side ink jet head unit H2 has the extension portion 42 extending rearward from the above-mentioned ink supply room forming member 50 by a large margin; hence, the lower-side ink jet head unit H2 is formed to become longer rearward than the upper-side ink jet head unit H1.

By this, the bonding surfaces to the respective circuit boards 6 (the upper surface of the ink supply room forming member 50 and the extension portion 42 of the bottom-side base plate 40) are formed to become stepwise as shown in the drawing. Accordingly, by making the structure such one, compared to the mode shown in FIG. 26, all the bonding operations to the respective circuit boards 6 can be carried out from only one direction (from the upper direction in FIG. 27); therefore, the efficiency of the bonding operation becomes excellent. In particular, in this mode of the embodiment, there is also an advantage that, after the ink jet head units H1 and H2 are stacked in the vertical direction, all the circuit boards 6*a*, 6*b*, - - - are bonded afterwards.

Also in the case where the number of stacked layers is further increased to 3 stages, 4 stages, or more, it is desirable to make the bonding surfaces to the respective circuit boards 6 be formed stepwise, because all the circuit boards 6*a*, 6*b*, - - - can be bonded afterwards.

(Tenth Embodiment)

In the following, the tenth embodiment of this invention will be explained with reference to the drawings. In addition, the same signs as those in the first and fifth embodiments indicate the items of the same structure, and so long as an item has no particular difference from its equivalent item in the fifth or sixth embodiment, its detailed explanation will be omitted.

Figure 29:
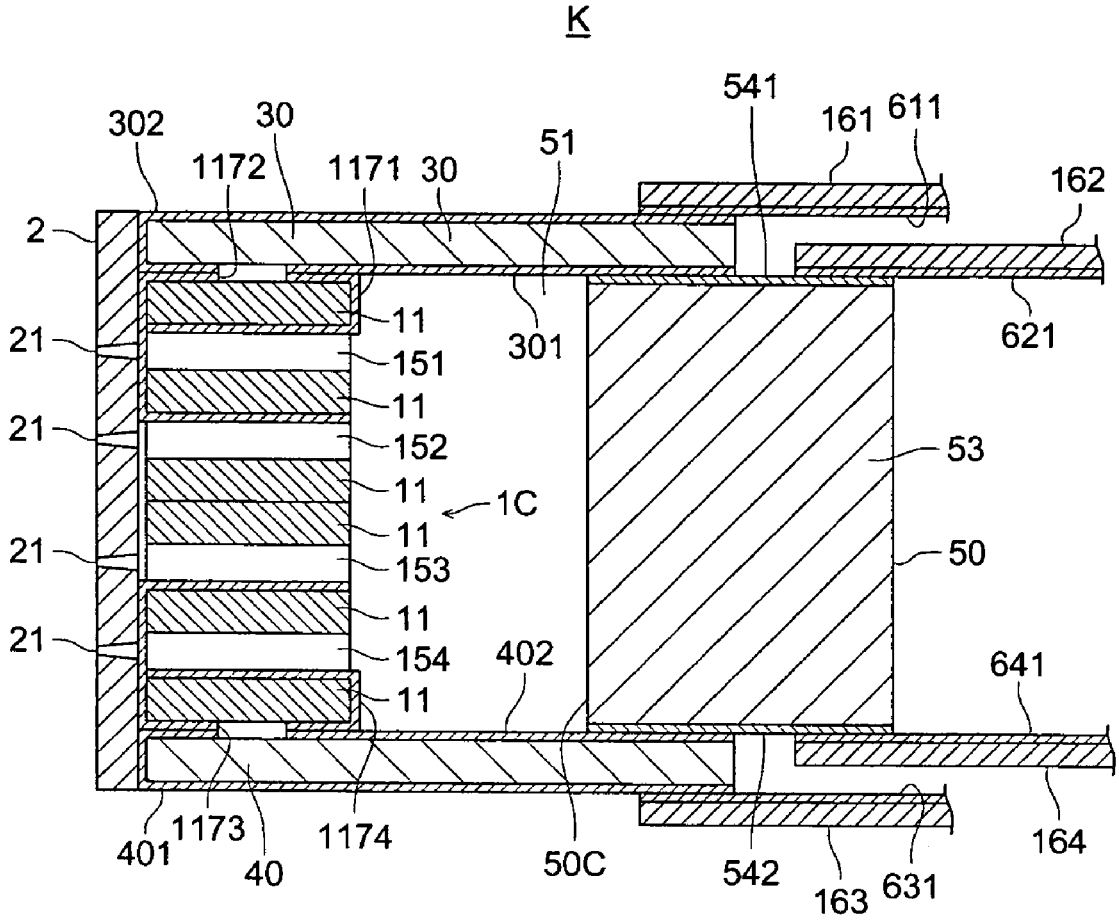
FIG. 29 is a cross-sectional view at the line (ii)—(ii) in FIG. 28.

FIG. 28 is an exploded perspective view of an ink jet head of this invention, FIG. 29 is the vertical cross-sectional view at the line (ii)—(ii) of the ink jet head shown in FIG. 28, FIG. 30(*a*) is the front view of a head chip, and FIG. 30(*b*) is the rear view of a head chip.

In the drawing, the sign K denotes an ink jet head, 1K denotes a head chip, 2 denotes a nozzle plate fixed to the front surface of the head chip 1K, 30 denotes a top-side base plate fixed to the upper surface of the head chip 1K, 40 denotes a bottom-side base plate fixed to the lower surface of the head chip 1K, and 50 denotes an ink supply room forming member.

In addition, in this specification, the side of a head chip from which ink drops are jetted is referred to as the "front" side, and the side opposite to that is referred to as the "rear" side, and their respective surfaces are referred to as the "front surface" and the "rear surface". Further, in this specification, the side of a head chip where the top-side base plate is fixed is referred to as the "upper" side, and the side where the bottom-side base plate is fixed is referred to as the "lower" side, and the outer surfaces located over and under the channel portions provided in an array in a head chip, both holding the channel portions in between, are referred to as the "upper surface" and the "lower surface" respectively.

As shown in detail in FIG. 30(*a*) and FIG. 30(*b*), the head chip 1K is composed of a plurality of stages stacked in the vertical direction each of which has a structure such that drive walls 14 (141 to 144) made up of a piezoelectric element 12 and channel portions 15 (151 to 154) are arranged alternately along the left to right direction between upper and lower two cover base plates (upper base plate and lower base plate) 11 and 11 making up the head chip 1K. In the example shown in the drawings, a head chip having four stages (a1 to a4) stacked in the vertical direction, each of which has four channel portions 15 and five drive walls 14 formed, is shown as an example. In addition, the channel portions 151 to 154 in one stage are deviated from those in the neighboring stages by a half pitch for every one of the stages a1 to a4.

In addition, although it is not shown in the drawings, also it is appropriate to form drive walls 14 similar to the above-mentioned ones, by one of piezoelectric-material base plates 12*a* and 12*b* being made thicker instead of the cover base plate 11, and by the formation of a plurality of parallel grooves having a depth from the side of the other of the piezoelectric-material base plates 12*a* and 12*b* up to the vertically middle position of the one of the piezoelectric-material base plates 12*a* and 12*b*.

As regards the shape of each of the channel portions 15, both the side walls are directed in the vertical direction (up-down direction), and are parallel to each other. Besides, it is of a straight type in which the size and the cross-sectional shape do not vary approximately over its length from the inlet to the outlet. Owing to the channel portions 15 being of a straight type in this way, it is possible to have an ink jet head having a good ability of removing bubbles, a high power efficiency, a small amount of heat generation, and a good high-speed response.

On the drive walls 14, there are formed drive electrodes 116 (1161 to 1164) facing the inside of the respective channel portions. For the metal for forming the drive electrodes 116 is Ni (nickel), Co (cobalt), Cu (copper), Al (aluminum), etc. can be cited; among these, Ni and Cu are desirable, and in particular, Ni is preferable.

In the head chip 1K, first lead wires 1171 to 1174 to be electrically connected to the respective drive electrodes formed on the respective drive walls 14 are made to come out on the upper and lower surfaces, in other words, up to the surface to be fixed to the top-side base plate 30 and the bottom-side base plate 40.

Among the four sets of (two couples of sets of) first lead wires 1171 to 1174, the first couple and the next couple of the sets are electrically connected to the respective drive electrodes 116 of the respective channel portions in the vertically neighboring upper two stages and lower two stages respectively; in each couple of the sets of first lead wires, the one set of first lead wires are placed on the front surface and the other set of them are placed on the rear surface for each stage, and the first and next couples of the sets of first lead wires are made to come out up to the fixing surface to the top-side base plate 30 and the bottom-side base plate 40 respectively. In the example shown in the drawings, the first lead wires 1171 to be electrically connected with the drive electrodes 1161 at the uppermost stage (a1) of the drive electrodes 1161 and 1162 in the two stages (a1, a2) located at the side of the top-side base plate 30, are made to come out up to the upper surface through the rear edge surface of the cover base plate 11 located at the direct upside of the drive electrodes 1161, on the rear surface of the head chip 1K, and the first lead wires 1172 to be electrically connected with the drive electrodes 1162 are made to come out up to the upper surface through the front edge surface of the respective drive walls 141 in the stage (a1) located at the upper side of the drive electrodes 1162, on the front surface of the head chip 1K. Further, the first lead wires 1174 to be electrically connected with the drive electrodes 1164 at the lowermost stage (a4) of the drive electrodes 1163 and 1164 in the two stages (a3, a4) located at the side of the bottom-side base plate 40, are made to come out up to the lower surface through the rear edge surface of the cover base plate 11 located at the direct downside of the drive electrodes 1164, on the rear surface of the head chip 1K, and the first lead wires 1173 to be electrically connected with the drive electrodes 1163 are made to come out up to the lower surface through the front edge surface of the respective drive walls 144 in the stage (a4) located at the lower side of the drive electrodes 1163, on the front surface of the head chip 1K.

Further, on the contrary, also it is appropriate to make the first lead wires 1172 and 1173 pass on the rear surface of the head chip 1K and the first lead wires 1171 and 1174 pass on the front surface of the head chip 1K.

Besides, the first lead wires 1171 to 1174 made to come out up to the upper surface or the lower surface through the front surface or the rear surface of the head chip 1K, as shown in FIG. 28, are positioned apart from one another so as not to be in contact with one another on the upper surface and on the lower surface.

The top-side base plate 30 and the bottom-side base plate 40 to be fixed to the upper surface and the lower surface of the head chip 1K respectively are made up of a base plate having a width approximately the same as the width of the head chip 1K (the length of the head chip 1K in the direction of the parallel arrangement of the channel portions 15) and a length sufficiently longer than the length of the head chip 1K (the length of the head chip 1K from the front surface to the rear surface), and on their surfaces, second lead wires 301 and 302, and 401 and 402 are formed parallel to one another respectively in correspondence with their respective first lead wires which are made to come out up to the upper surface and the lower surface of the head chip 1K with the same pitch as these.

That is, in the top-side base plate 30, the second lead wires 301 to be electrically connected to the first lead wires 1171 are formed on the lower surface of the top-side base plate 30 (inner surface) which is at the side to be fixed to the head chip 1K with the same number and pitch as the first lead wires 1171 in correspondence with their respective first lead wires 1171, extending rearward from said top-side base plate 30 up to the rear edge, and the second lead wires 302 to be electrically connected to the first lead wires 1172 are formed on the same lower surface of the top-side base plate 30 (inner surface) with the same number and pitch as the first lead wires 1172 in correspondence with their respective first lead wires 1172, and are made to come out through the front surface of the top-side base plate to its upper surface (outer surface) which lies opposite to the surface to be fixed to the head chip 1K, and extend rearward up to the rear edge on the upper surface of said top-side base plate 30.

Further, in the bottom-side base plate 40, the second lead wires 401 to be electrically connected to the first lead wires 1173 are formed on the upper surface of the bottom-side base plate 40 (inner surface) which is at the side to be fixed to the head chip 1K with the same number and pitch as the first lead wires 1173 in correspondence with their respective first lead wires 1173, and are made to come out through the front surface of the bottom-side base plate to its lower surface (outer surface) which lies opposite to the surface to be fixed to the head chip 1K, and extend rearward up to the rear edge on the upper surface of said bottom-side base plate 40, and the second lead wires 402 to be electrically connected to the first lead wires 1174 are formed on the same upper surface of the bottom-side base plate 40 (inner surface) with the same number and pitch as the first lead wires 1174 in correspondence with their respective first lead wires 1174, and extend rearward up to the rear edge of said bottom-side base plate 40.

These top-side base plate and the bottom-side base plate are fixed to the upper surface and to the lower surface of the head chip 1K respectively by means of an adhesive, an anisotropic conductive film, or the like, in such a manner that their front edge surface come to be flush with the front surface of the head chip 1K, with the second lead wires 301 and 302, and 401 and 402 made to face their respective first lead wires 1171 to 1174 in order that the first lead wires 1171 to 1174 can be electrically connected with the second lead wires 301 and 302, and 401 and 402 corresponding to them.

By this, the head chip 1K is brought in a state that it is held by the top-side base plate 30 and the bottom-side base plate 40 located at its upper side and at its lower side respectively, each extending rearward from the head chip 1K, and by these top-side base plate 30 and the bottom-side base plate 40, the lead wires to be connected to the respective drive electrodes 161 to 164 are made to come out from the head chip 1K up to its rear side.

The nozzle plate 2 is fixed to the front surface side of the head chip 1K having the top-side base plate 30 and the bottom-side base plate 40 each fixed to it. In the nozzle plate 2, nozzle holes 21 corresponding to the respective channel portions 15 are opened.

The ink supply room forming member 50 is provided at the rearward position between the top-side base plate 30 and the bottom-side base plate 40, and makes up an ink supply room for supplying ink to each of the channel portions 15 at the rear surface side of said head chip 1K.

The ink supply room forming member 50 shown in this embodiment of the invention represents one desirable mode of the invention in which its rear wall 50*c* projects rearward from the rear edge of the top-side base plate 30 and the bottom-side base plate 40 to form a projection portion 53. At the rearward part of the ink supply room forming member 50, the surfaces which are the same as the above-mentioned surfaces to be fixed to the top-side base plate and to the bottom-side base plate respectively project from said top-side base plate 30 and bottom-side base plate 40 and are partly exposed upward and downward respectively.

On this ink supply room forming member 50, there are formed third lead wires 541 and 542, whose one end are electrically connected with the second lead wires 301 and 401 among the above-mentioned second lead wires 301 and 302, and 401 and 402 each formed extending up to the rear edge of the top-side base plate 30 and the bottom-side base plate 40 on the lower surface of the top-side base plate 30 and on the upper surface of the bottom-side base plate 40, in other words, on the inner surface of them, while the other end of them are made to come out up to on the surfaces exposed to the outside in said ink supply room forming member 50. In this example, the third lead wires 541 on one side are formed parallel to one another with the same number and pitch as the second lead wires 301 on the upper surface of the ink supply room forming member 50, and are made to come out up to on the upper surface of the projection portion 53 of said ink supply room forming member 50. Further, the third lead wires 542 on the other side are formed parallel to one another with the same number and pitch as the second lead wires 402 on the lower surface of the ink supply room forming member 50, and are made to come out up to on the lower surface of the projection portion 53 of said ink supply room forming member 50. Such the third lead wires 541 and 542 can be formed by a patterning being applied to the ink supply room forming member 50, and the deposition of a metal film by the use of an electroless plating or the like.

By this, the lead wires to be electrically connected with the drive electrodes 1161 to 1164 in the respective stages of the head chip 1K are exposed on the head surface in each of the upper surface of the top-side base plate 30, the lower surface of the bottom-side base plate 40, and the upper and lower surfaces of the projection portion 53 of the ink supply room forming member 50; therefore, even the drive electrodes in the second or third stage located at the middle part of the head chip 1K in terms of the vertical direction can be electrically connected to a drive circuit in the outside of the ink jet head K easily.

That is, to this ink jet head K, corresponding to the stages al to a4 of the head chip 1K, the four circuit boards 161 to 164 to be electrically connected to the respective drive electrodes are bonded. The circuit board 161 is bonded to the upper surface of the top-side base plate 30 by means of an anisotropic conductive film, in such a manner that the lead wires 611 formed on its lower surface are electrically connected with the second lead wires 302 which are made to come out to the upper surface of the top-side base plate 30 and extend rearward from the ink jet head K. The circuit board 162 is bonded to the upper surface of the projection portion 53 of the ink supply room forming member 50 by means of an anisotropic conductive film, in such a manner that the lead wires 621 formed on its lower surface are electrically connected with the third lead wires 541 which are made to come out to the upper surface of the projection portion 53 of the ink supply room forming member 50 and extend rearward from the ink jet head K. The circuit board 163 is bonded to the lower surface of the bottom-side base plate 40 by means of an anisotropic conductive film, in such a manner that the lead wires 631 formed on its upper surface are electrically connected with the second lead wires 401 which are made to come out to the lower surface of the bottom-side base plate 40 and extend rearward from the ink jet head K. The circuit board 164 is bonded to the lower surface of the projection portion 53 of the ink supply room forming member 50 by means of an anisotropic conductive film, in such a manner that the lead wires 641 formed on its upper surface are electrically connected with the third lead wires 542 which are made to come out to the lower surface of the projection portion 53 of the ink supply room forming member 50 and extend rearward from the ink jet head K.

Because the circuit boards 161 and 163 are fixed by the utilization of the outer surface of the top-side base plate 30 and that of the bottom-side base plate 40, and the circuit boards 162 and 164 are fixed by the utilization of the upper surface and the lower surface of the projection portion 53 of the ink supply room forming member 50 in this way, the direction of the electrical connection of all the circuit boards 161 to 164 are made rearward to be equal to one another, and the ink jet head K is electrically connected with a drive circuit by the electrical connection with these circuit boards 161 to 164, which makes it possible to apply an voltage to each of the drive electrodes 161 to 164.

It is desirable that the circuit boards 161 to 164 for making the electrical connection with a drive circuit are flexible boards (FPC). Further, it is desirable that each of the circuit boards 161 to 164 is equipped with a drive IC, because the reduction of the number of connection terminals can be achieved.

It is desirable that at least one of the members except for the drive walls 14 in the head chip 1K (the cover base plate 11 in this embodiment), the top-side base plate 30, and the bottom-side base plate 40 is made of any one material selected from a ceramic material containing aluminum nitride as a constituent, a piezoelectric material, and a liquid crystal polymer. By this, it is given an effect that an ink jet head which has an excellent heat dissipation property, and is stable against temperature variation can be obtained.

Further, it is more desirable that the thermal expansion coefficient of at least one of the members except for the drive walls 14 in the head chip 1E (the cover base plate 11 in this embodiment), the top-side base plate 30, and the bottom-side base plate 40 is the thermal expansion coefficient of the piezoelectric element 12 making up the drive walls 14 $\pm 2\times10^{-6}/°$ C. By the thermal expansion coefficient being made to fall within this range, separation etc. between the base plates due to the difference in the thermal expansion coefficient are not produced.

Further, because a part of the first lead wires 117 and the second lead wires 301 and 402 face the ink supply room 51, these are in direct contact with the ink in the same way as the drive electrodes 116 in the channel portions 15. Accordingly, for the purpose of enabling the use of an aqueous ink for the ink, it is desirable to form an electrode protection film on the surface of the drive electrodes 116, the first lead wires 117, and the second lead wires 301, 402. For the electrode protection film, an organic insulating film such as a parylene film is desirable because it has flexibility, is hard to peel off, is easy to comply with the shear deformation of the drive walls 14, and improves more the durability of the drive electrodes 116.

Incidentally, as regards the manufacturing method of the head chip 1K, its explanation will be omitted because it is the same as the manufacturing method of the head chip 1 of the first embodiment.

Figure 31:
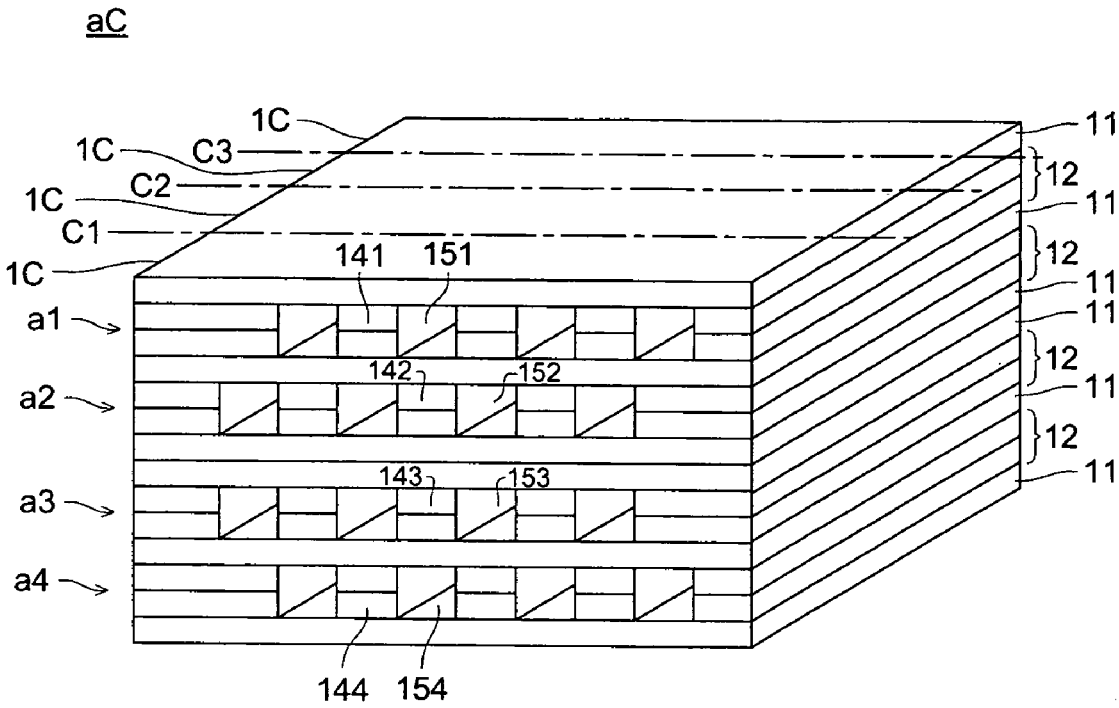
FIG. 31 is a drawing showing one process of a manufacturing method of an ink jet head.

In the same way as the head chip 1 of the first embodiment, two pieces of head chip base plate having the drive electrodes 116 formed in it are prepared. In this example, a cover plate 11 is used in place of the lower base plate 13. The two head chip base plates are stacked with the channel portions deviated from each other by a half pitch, a cover base plate 11 is fixed further on the upper side, and a head chip base plate having the drive walls and the channel portions stacked in upper and lower two stages is formed; after that, by the stacking of two pieces of this head chip base plate having two stages, a head chip base plate aC having vertically stacked four stages (a1 to a4) is formed as shown in FIG. 31.

Next, this head chip base plate aC is cut along the cut lines C1, C2, C3, - - - approximately perpendicular to the length direction of the channel portions 15, and a plurality of head chips 1K, 1K, 1K, - - - are produced from one piece of head chip base plate aC.

Figure 32:
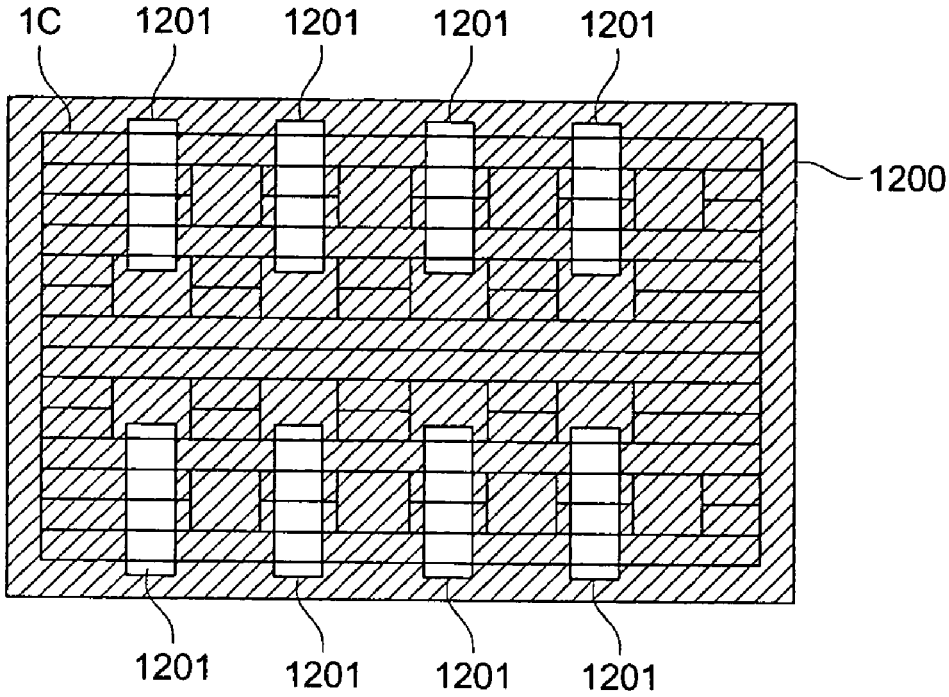
FIG. 32 is a drawing showing one process of a manufacturing method of an ink jet head.

As shown in FIG. 32, to each of the cut surfaces (the front surface and the rear surface of the head chip 1K) of the produced head chip 1K, patterning is applied by means of a dry film 1200 having openings 1201 for the formation of first lead wires corresponding to the respective channel portions 15, and after that, aluminum is coated by evaporation coating; by this processing, a part of the first lead wires, that is, the portion of the first lead wires lying on the front surface and that on the rear surface of the head chip 1K are formed.

Figure 33:
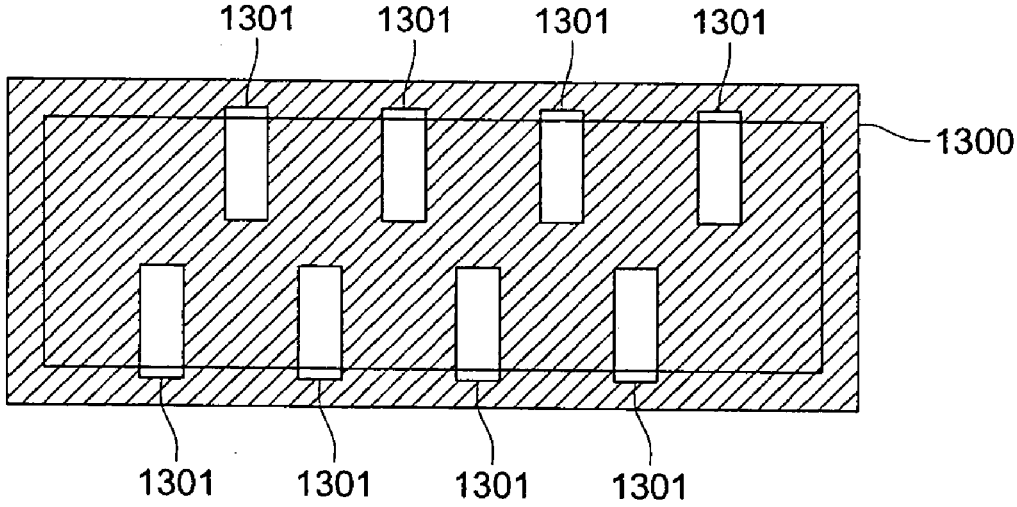
FIG. 33 is a drawing showing one process of a manufacturing method of an ink jet head.

Further, as shown in FIG. 33, as regards the upper surface and the lower surface of the head chip 1K, patterning is applied to them by means of a dry film 1300 having openings 1301 for the first lead wires corresponding to the respective channel portions 15, and after that, aluminum is coated by evaporation coating; by this processing, the rest portions of the first lead wires to be electrically connected to the first lead wires having been formed on the front surface and the rear surface of the head chip 1K are formed on them. In addition, also it is appropriate to form lead wires previously by a pattern shown in FIG. 33 on the cover base plates 11 corresponding to the upper surface and the lower surface of the head chip 1K.

As regards the method of forming these lead wires, it is not limited to evaporation coating, but a sputtering method can be also used.

After that, by the removal of the dry film and the aluminum film formed on it with a solvent, it is obtained a state shown in FIG. 30(*a*) and FIG. 30(*b*) that the first lead wires are made to come out from the respective drive electrodes 1161 to 1164 to the upper surface and the lower surface of the head chip 1K through its front surface and rear surface.

For the ink jet head K explained up to now, one having the head chip 1K composed of four stages of a1 to a4 is shown as an example; however, only it is necessary for the head chip 1K to have a plurality of stages in which the drive walls 14 and the channel portions 15 are arrayed parallel to one another stacked in the vertical direction; the structure is not limited to one having four stages, but it is appropriate to make the structure have at least two stages. However, if the number of stages of the head chip is made five or more, the pitch of the first lead wires of each stage becomes narrow, and the bonding with the circuit board becomes difficult; therefore, it is desirable to make the number of the stages of the head chip two, three, or four, and a four-stage structure is most desirable if both the degree to which the density of the ink jet head is made higher and the operation efficiency are taken into consideration.

(Effect of Invention)

As described up to now, by this invention, it is possible to provide an ink jet head which makes it possible to carry out simply the electrical connection of the drive electrodes in the respective channels with the connection wires from a drive circuit, and makes it possible to practice easily the formation of the ink supply room for carrying out the ink supply into each of the channel portions.

What is claimed is:

1. An ink jet head comprising:

a head chip formed substantially in rectangular solid having six outer planes of a front plane, a rear plane, a top plane, a bottom plane, and two opposite side planes, wherein the head chip has drive walls made up of piezoelectric elements and channel portions alternately arranged in parallel, the channel portions are enclosed with the drive walls, the top plane and the bottom plane, and outlets and inlets of the channel portions are arranged in an opposite manner at the front plane and the rear plane of the head chip respectively;

a nozzle plate fixed on the front plane of the head chip;

a top-side base plate fixed on the top plane of the head chip, the top-side base plate having a first extended portion extending rearward beyond the rear plane of the head chip;

a bottom-side base plate fixed on the bottom plane of the head chip, the bottom side base plate having a second extended portion extending rearward beyond the rear plane of the head chip;

an ink supply room forming member for forming an ink supply room to supply ink to each of the channel portions, the ink supply room forming member being provided at the rear plane side of the head chip, sandwiched by the first extended portion of the top-side base plate and the second extended portion of the bottom-side base plate;

first lead wires to be electrically connected to their respective drive electrodes formed on the drive walls, the first lead wires being formed on a fixed plane surf ace of the head chip where the head chip is fixed to at least one of the top-side base plate and the bottom-side base plate; and second lead wires to be electrically connected to their respective first lead wires, the second lead wires being formed on a plane surface of at least one of the top-side base plate or the bottom-side base plate at the side of the fixed surface of the head chip wherein each of the second lead wires is superposed on a respective lead wire of the first lead wires to form direct electrical connections between the first lead wires and the second lead wires.

2. The ink jet head of claim 1, wherein the head chip comprises the drive walls and the channel portions, both of the drive walls and the channel portions being formed in two stages in the vertical direction.

3. The ink jet head of claim 2, wherein one of the top-side base plate and the bottom-side base plate is formed to have a size relatively longer than the size of the other, and extends rearward from the ink supply room forming member to form an extension portion, the extension portion being electrically connected to a drive circuit by means of the second lead wire, wherein on the surface of the other of the top-side base plate and bottom-side base plate having a relatively shorter size, third lead wires are formed at a side of a fixed surface where the head chip is fixed, each of the third lead wires having one end electrically connected to each of second lead wires and the other end electrically connected to a drive circuit on the outer surface of the ink supply room forming member.

4. The ink jet head of claim 3, wherein the other end of the third lead wires being made to come out to the rear surface side of the ink supply room forming member and being electrically connected to the drive circuit on the rear surface of said ink supply room forming member.

5. The ink jet head of claim 3, wherein the ink supply room forming member having a projection portion projecting rearward from the other of the top-side base plate and the bottom-side base plate having a relatively shorter size, and the other end of the third lead wires being electrically connected to the drive circuit on the same surface as the surface of the head chip to be fixed to said base plate at said projection portion.

6. An ink jet head comprising a plurality of ink jet heads having a feature described in claim 3, said plurality of ink jet heads being stacked in a multi-stage manner in the vertical direction.

7. The ink jet head of claim 6, wherein in any two neighboring ink jet beads of the plurality of ink jet heads, a base plate having a relatively longer size of one of the two neighboring ink jet heads is placed opposite to a base plate having a relatively shorter size of the other of the two neighboring ink jet heads, and said base plate having a relatively longer size and said base plate having a relatively shorter size are formed to have approximately the same length.

8. The ink jet head of claim 6, wherein a heat dissipation member is provided between any two neighboring ink jet heads of the plurality of ink jet heads stacked.

9. The ink jet head of claim 1, further comprising rear face lead wires formed on the rear plane of the head chip, wherein the first lead wires are electrically connected through the rear face lead wires to their respective drive electrodes formed on the drive walls.

10. The ink jet head of claim 9, further comprising an electrode protection film being formed on the surface of the drive electrodes, the rear face lead wires, and the second lead wires.

11. The ink jet head of claim 1, further comprising a flexible board equipped with a drive IC, said flexible board being electrically connected to at least one of the top-side base plate and the bottom-side base plate, on which the second lead wires are formed.

12. The ink jet head of claim 1, wherein a drive IC is provided on at least one of the top-side base plate and the bottom-side base plate, on which the second lead wires are formed.

13. The ink jet head of claim 1, wherein at least one of members of the top-side base plate, and the bottom-side base plate is made of any material selected from a ceramic material containing aluminum nitride as a constituent, a piezoelectric material, and a liquid crystal polymer.

14. The ink jet head of claim 1, wherein thermal expansion coefficient of at least one of members of the top-side base plate, and the bottom-side base plate is the thermal expansion coefficient of the piezoelectric element ±2 ppm/° C.

15. The ink jet head of claim 1, wherein the ink supply room forming member comprises two opposite side walls and a rear wall, the rear wall comprising:

a front wall plane provided to face the rear plane of the head chip;

a top outer plane fixed to a plane surface of the first extended portion of the top-side base plate;

a bottom outer plane fixed to a plane surface of the second extended portion of the bottom-side base plate; and a rear outer plane arranged opposite to the front wall plane, wherein the ink supply room is formed of a space enclosed by the first extended portion of the top-side base plate, the second extended portion of the bottom-side base plate, the rear plane of the head chip, the two opposite side walls and the front wall plane, wherein third lead wires are formed on a surface of at least one of the top outer plane and the bottom outer plane of the rear wall of the ink supply room forming member, each of said third lead wires having one end electrically connected to each of the second lead wires as well as the other end electrically connected, to a drive circuit wherein each of the second lead wires is superposed on a respective wire of the third lead wires to form direct electrical connections between the second lead wires and the third lead wires.

16. The ink jet head of claim 15, wherein each of the other end of the third lead wires comes out to the rear outer plane of the rear wall of the ink supply room forming member, and electrically connected with the drive circuit at a surface of the rear outer plane of the rear wall of the ink supply room forming member.

17. The ink jet head of claim 15, wherein the rear wall of the ink supply room forming member has a projection portion jutting out rearward from both the extended portions of the top-side base plate and the bottom-side base plate, and each of the other end of the third lead wires is electrically connected with the drive circuit, at a surface of at least one of the top outer plane and the bottom outer plane in the projection portion of the rear wall of the ink supply room forming member.

18. The ink jet head of claim 15, wherein the head chip comprises the drive walls and the channel portions formed in two stages in the vertical direction.

19. An ink jet head comprising a plurality of ink jet heads having a feature described in claim 18, said plurality of ink jet heads being stacked in a multi-stage manner in the vertical direction.

20. The ink jet head of claim 19, wherein a heat dissipation member is provided between any two neighboring ink jet heads of the plurality of ink jet heads stacked.

21. The ink jet head of claim 15, wherein each of the first lead wires comes out from the respective drive electrodes through at least one of a surface of the front plane and a surface of the rear plane of the head chip onto the surface of at least one of the top plane and the bottom plane of the head chip where the head chip is fixed to the top-side base plate or the bottom-side base plate.

22. The ink jet head of claim 15, wherein an electrode protection film is formed on the surface of the drive electrodes, the first lead wires, and the second lead wires facing the ink supply room.

23. The ink jet head of claim 15, wherein at least one of members of the top-side base plate, and the bottom-side base plate is made of any material selected out of a ceramic material containing aluminum nitride as a constituent, a piezoelectric material, and a liquid crystal polymer.

24. The ink jet head of claim 15, wherein the thermal expansion coefficient of at least one of members of the top-side base plate, and the bottom-side base plate has the thermal expansion coefficient of the piezoelectric element ±2 ppm/° C.

25. The ink jet head of claim 1, wherein the head chip comprises the drive walls and the channel portions, both of the drive walls and the channel portions being stacked in plural stages in the vertical direction, among the first lead wires, first lead wires to be electrically connected to the drive electrodes of the respective channel portions in a couple of stages adjacent to each other in the vertical direction of the head chip being distributed to the front surface and the rear surface respectively for each stage, and being made to come out onto the upper surface or the lower surface of the head chip, one end of those second lead wires, the other end which are electrically connected to each of first lead wires made to come out through one of the front surface and the rear surface of said head chip, being made to come Out from the surface to be fixed to the head chip to the outside surface, while one end of those second lead wires, the other end of which are electrically connected to each of, among the first lead wires, those which are made to come out through the other of the front surface and the rear surface of the head chip extending rearward on the surface to be fixed to the head chip.

26. The ink jet head of claim 25 wherein the third lead wires are formed on the ink supply room forming member and exposed on the surface of the head, the third lead wires being electrically connected with the other end of the second lead wires whose one end extend rearward on the surface to be fixed to the head chip.

27. The ink jet head of claim 26, wherein the ink supply room forming member has a projection portion projecting rearward from the top-side base plate or the bottom-side base plate on which the second lead wires are formed on both of the outer surface and the surface to be fixed to the head chip, the other end of the third lead wires being exposed on the surface of the head in the projection portion.

28. The ink jet head of claim 25, wherein an electrode protection film is formed on the surface of the drive electrodes, and the first lead wires and the second lead wires each facing the ink supply room.

29. The ink jet head of claim 25, wherein at least one of the members except for the drive walls in the head chip, the top-side base plate, and the bottom-side base plate being made of any material selected out of a ceramic material containing aluminum nitride as a constituent, a piezoelectric material, and a liquid crystal polymer.

30. The ink jet head of claim 25, wherein the thermal expansion coefficient of at least one of the members except for the drive walls in the head chip, the top-side base plate, and the bottom-side base plate is the thermal expansion coefficient of the piezoelectric element ±2 ppm/° C.

* * * * *